US012262785B2

(12) United States Patent
Weast et al.

(10) Patent No.: US 12,262,785 B2
(45) Date of Patent: Apr. 1, 2025

(54) FLUID FLOW CONTROL DEVICES USABLE IN ADJUSTABLE FOOT SUPPORT SYSTEMS

(71) Applicant: NIKE, Inc., Beaverton, OR (US)

(72) Inventors: Aaron B. Weast, Portland, OR (US); Timothy P. Hopkins, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 181 days.

(21) Appl. No.: 17/483,163

(22) Filed: Sep. 23, 2021

(65) Prior Publication Data

US 2022/0007786 A1 Jan. 13, 2022

Related U.S. Application Data

(62) Division of application No. 16/425,331, filed on May 29, 2019, now Pat. No. 11,147,342.

(60) Provisional application No. 62/678,635, filed on May 31, 2018.

(51) Int. Cl.
*A43B 13/20* (2006.01)

(52) U.S. Cl.
CPC ..... *A43B 13/203* (2013.01)

(58) Field of Classification Search
None
See application file for complete search history.

(56) References Cited

U.S. PATENT DOCUMENTS 5,406,719 A 4/1995 Potter
5,771,606 A 6/1998 Litchfield et al.
6,125,556 A * 10/2000 Peckler ..... A43C 15/14 36/134
6,402,879 B1 6/2002 Tawney et al.
7,448,150 B1 * 11/2008 Davis ..... A43B 13/203 36/35 B
8,857,076 B2 10/2014 Langvin et al.
(Continued)

FOREIGN PATENT DOCUMENTS

CN 1372443 A 10/2002
CN 1589692 A 3/2005
(Continued)

OTHER PUBLICATIONS

Sep. 13, 2019—(WO) ISR & WO—App. No. PCT/US19/034278.
(Continued)

*Primary Examiner* — Jila M Mohandesi
(74) *Attorney, Agent, or Firm* — Banner & Witcoff, Ltd.

(57) ABSTRACT

Foot support systems include a fluid flow regulator and/or valve that: (a) can operate as a stop valve to stop transfer of fluid between a first fluid container and a second fluid container, (b) can open in a controlled manner to allow transfer of fluid from the second fluid container to the first fluid container, (c) can open to equalize pressure in the first and second fluid containers, and (d) can act as a check valve to enable flow of fluid from the first fluid container to the second fluid container when/if gas pressure in the first container exceeds that in the second container by a predetermined amount. Additional features relate to fluid flow control systems and methods, systems and methods for changing and controlling the crack pressure of a valve (e.g., a check valve), and/or systems and methods for matching foot support pressure features in two different sole structures.

18 Claims, 22 Drawing Sheets

(56) References Cited

U.S. PATENT DOCUMENTS

| | | | | |
|---|---|---|---|---|
| 9,560,894 | B2 | 2/2017 | Langvin et al. | |
| 10,258,105 | B2 | 4/2019 | Langvin et al. | |
| 10,842,226 | B2 | 11/2020 | Langvin et al. | |
| 11,457,695 | B2 | 10/2022 | Langvin et al. | |
| 11,849,803 | B2 | 12/2023 | Langvin et al. | |
| 2007/0069172 | A1 | 3/2007 | Brenner et al. | |
| 2008/0098620 | A1 | 5/2008 | Marvin et al. | |
| 2011/0067264 | A1 | 3/2011 | Doyle | |
| 2012/0234111 | A1 | 9/2012 | Molyneux et al. | |
| 2012/0255198 | A1* | 10/2012 | Langvin | F16K 11/076 36/29 |
| 2013/0191034 | A1* | 7/2013 | Weast | G16H 20/30 702/19 |
| 2014/0068973 | A1 | 3/2014 | Krupenkin et al. | |
| 2014/0165427 | A1* | 6/2014 | Molyneux | A43B 13/20 36/102 |
| 2016/0044993 | A1 | 2/2016 | Meschter et al. | |
| 2024/0074535 | A1 | 3/2024 | Langvin et al. | |

FOREIGN PATENT DOCUMENTS

| | | | | |
|---|---|---|---|---|
| CN | 1213672 | C | 8/2005 | |
| CN | 1777370 | A | 5/2006 | |
| CN | 105163619 | A | 12/2015 | |
| DE | 102015225209 | A1 * | 6/2017 | |
| JP | 2012016447 | A | 1/2012 | |
| KR | 101226783 | B1 | 2/2013 | |
| TW | 286269 | B | 9/1996 | |
| TW | M323543 | U | 12/2007 | |
| TW | I605768 | B | 11/2017 | |
| WO | WO-2008051164 | A1 * | 5/2008 | A43B 13/203 |

OTHER PUBLICATIONS

Dec. 14, 2022 (TW) Office Action—TW Patent App 110133031, with English translation, 26 pages.

Mar. 6, 2024 (EP)—Communication with European Search Report, EP Patent App. No. 23212503.9, 8 pages.

* cited by examiner

FLUID FLOW CONTROL DEVICES USABLE IN ADJUSTABLE FOOT SUPPORT SYSTEMS

RELATED APPLICATION DATA

This application is: (a) a divisional of U.S. patent application Ser. No. 16/425,331 filed May 29, 2019, which application is (b) a U.S. Non-Provisional Application of and claims priority benefits based on U.S. Provisional Patent Appln. No. 62/678,635 filed May 31, 2018. Each of U.S. patent application Ser. No. 16/425,331 and U.S. Provisional Patent Appln. No. 62/678,635 is entirely incorporated herein by reference. Additional aspects and features of this invention may be used in conjunction with the systems and methods described in U.S. Provisional Patent Appln. No. 62/463,859 filed Feb. 27, 2017; U.S. Provisional Patent Appln. No. 62/463,892 filed Feb. 27, 2017; and U.S. Provisional Patent Appln. No. 62/547,941 filed Aug. 21, 2017. Each of U.S. Provisional Patent Appln. No. 62/463,859, U.S. Provisional Patent Appln. No. 62/463,892, and U.S. Provisional Patent Appln. No. 62/547,941 is entirely incorporated herein by reference.

FIELD OF THE INVENTION

The present invention relates to foot support systems in the field of footwear or other foot-receiving devices. More specifically, aspects of the present invention pertain to foot support systems, e.g., for articles of footwear, that include systems for changing the hardness or firmness of the foot support portion and/or systems for selectively moving fluid (gas) between various portions of the foot support system/footwear. Additional aspects of this invention relate to fluid flow control systems and methods, systems and methods for changing and controlling the crack pressure of a valve (e.g., a check valve), and/or systems and methods for matching foot support pressure features in two different sole structures (e.g., different shoe soles of a pair, a later made pair of shoes for the same user (with support features to match an earlier pair), etc.).

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

SUMMARY

This Summary is provided to introduce some general concepts relating to this invention in a simplified form that are further described below in the Detailed Description. This Summary is not intended to identify key features or essential features of the invention.

Aspects of this invention relate to the foot support systems, articles of footwear, and/or other foot-receiving devices, e.g., of the types described and/or claimed below and/or of the types illustrated in the appended drawings. Such foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Additional aspects of this invention relate to fluid flow control systems and methods, systems and methods for changing and controlling the crack pressure of a valve (e.g., a check valve), and/or systems and methods for matching foot support pressure features in two different sole structures (e.g., different shoe soles of a pair, a later made pair of shoes for the same user (with support features to match an earlier pair), etc.).

While aspects of the invention are described in terms of fluid flow control systems, foot support systems, and articles of footwear including them, additional aspects of this invention relate to methods of making such fluid flow control systems, foot support systems, and/or articles of footwear and/or methods of using such fluid flow control systems, foot support systems, and/or articles of footwear.

BRIEF DESCRIPTION OF THE DRAWINGS

The foregoing Summary, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
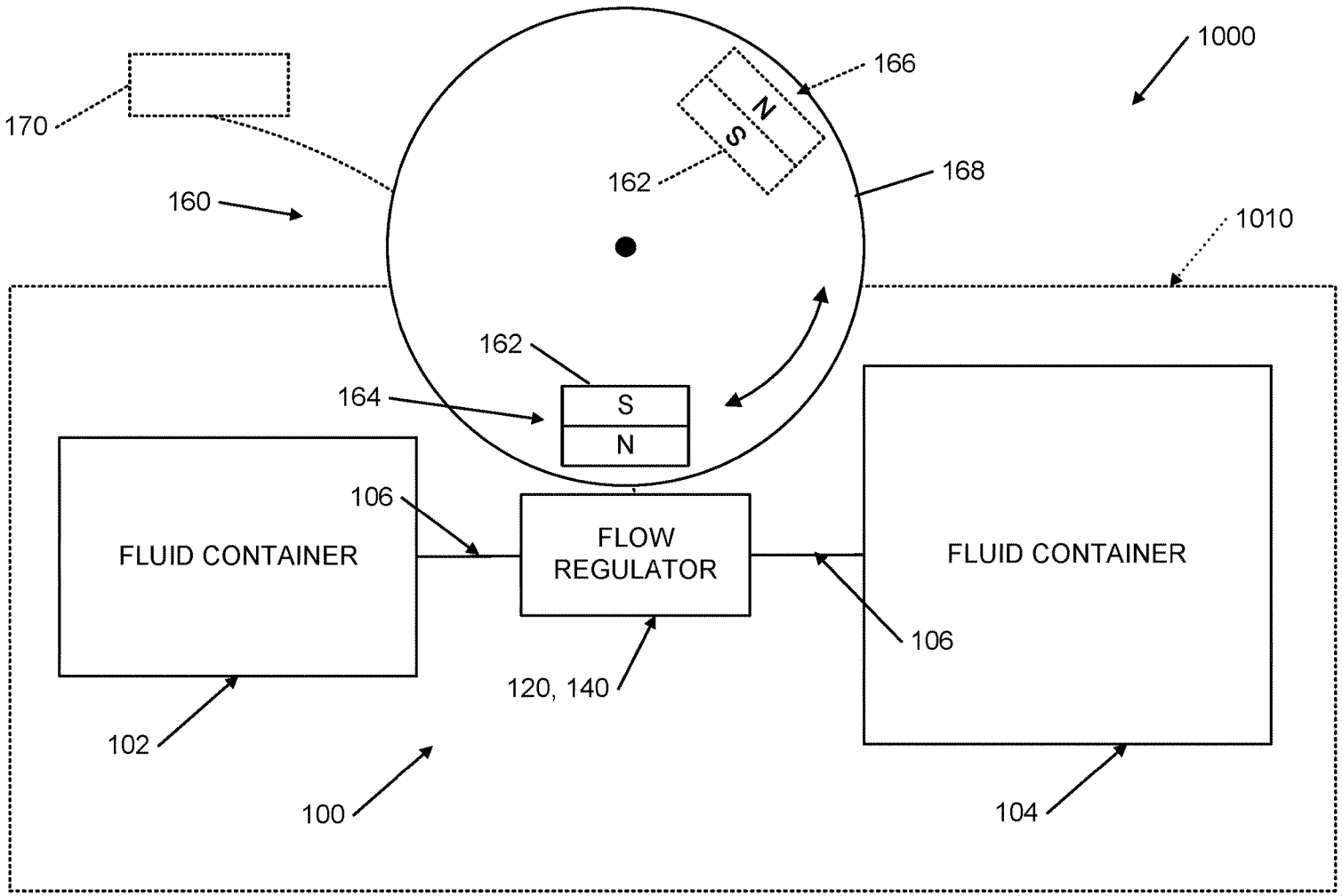
FIGS. 1A-1E schematically illustrate articles of footwear including fluid containers (e.g., fluid-filled bladders) and fluid flow control devices for moving fluid between fluid containers in the articles of footwear in accordance with examples of this invention.

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made to the specifically described structures and methods without departing from the scope of the present invention.

I. General Description of Aspects of this Invention

As noted above, aspects of this invention relate to fluid flow control systems, foot support systems, articles of footwear, and/or other foot-receiving devices, e.g., of the types described and/or claimed below and/or of the types illustrated in the appended drawings. Such fluid flow control systems, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Foot support systems in articles of footwear in accordance with at least some examples of this invention include systems for changing the hardness or firmness of the foot support portion and/or systems for moving fluid between various portions of the foot support system. Such foot support systems may include a fluid flow regulator and/or valve that: (a) can operate as a stop valve to stop transfer of fluid between a first fluid container and a second fluid container in the foot support system/article of footwear, (b) can open in a controlled manner to allow transfer of fluid from the second fluid container to the first fluid container, (c) can open to equalize pressure in the first and second fluid containers, and (d) can act as a check valve to enable flow of fluid from the first fluid container to the second fluid container when/if gas pressure in the first container exceeds that in the second container by a predetermined amount.

Some example foot support systems and/or articles of footwear in accordance with this invention will include: (a) a first footwear component; (b) a first fluid-filled container or bladder support engaged with the first footwear component, wherein the first fluid-filled container or bladder support includes a gas at a first pressure; (c) a second fluid-filled container or bladder support engaged with the first footwear component or a second footwear component, wherein the second fluid-filled container or bladder support includes a gas at a second pressure; (d) a first fluid transfer line placing the first fluid-filled container or bladder support in fluid-communication with the second fluid-filled container or bladder support; (e) a valve located in or connected to the first fluid transfer line, wherein the valve includes:

- a fixed valve part including a valve component seating area, and
- a movable valve part including a portion movable into and out of contact with the valve component seating area; and (f) a control system configured to change the valve between an open condition and a closed condition. In this example system, when the second pressure is greater than the first pressure, the control system: (a) holds the valve in the closed condition and inhibits gas from moving from the second fluid-filled container or bladder support, through the first fluid transfer line and valve, and into the first fluid-filled container or bladder support or (b) is selectively controllable to move the valve to the open condition and allow fluid to move from the second fluid-filled container or bladder support, through the first fluid transfer line and valve, and into the first fluid-filled container or bladder support. When the first pressure is greater than the second pressure by at least a first predetermined amount, gas from the first fluid-filled container or bladder support: (a) causes the movable valve part to move out of contact with the valve component seating area and (b) moves from the first fluid-filled container or bladder support, through the valve and first fluid transfer line, and into the second fluid-filled container or bladder support. The first fluid transfer line may constitute one, two, or more component parts.

Additionally or alternatively, some example foot support systems and/or articles of footwear in accordance with this invention will include: (a) a first footwear component; (b) a first fluid-filled container or bladder support engaged with the first footwear component; (c) a second fluid-filled container or bladder support engaged with the first footwear component or a second footwear component; (d) a first fluid transfer line placing the first fluid-filled container or bladder support in fluid-communication with the second fluid-filled container or bladder support; (e) a valve located in or connected to the first fluid transfer line, wherein the valve is switchable between: (i) an open condition in which fluid flows through the valve and through the first fluid transfer line and (ii) a closed condition in which fluid flow through the first fluid transfer line is stopped by the valve, wherein the valve includes:

- a fixed valve part including a valve component seating area, and
- a movable valve part including a portion movable into and out of contact with the valve component seating area; and (f) a control system that changes the valve between the open condition and the closed condition. The control system may operate in the manner described above.

Additional aspects of this invention relate to fluid flow control systems and methods that include: (a) a fluid line having a first end and a second end opposite the first end, wherein the fluid line defines an interior surface extending between the first end and the second end, wherein the interior surface defines an interior chamber through which fluid will flow; (b) a fixed valve part sealingly engaged with the interior surface of the fluid line, wherein the fixed valve part includes a valve component seating area; (c) a movable valve part movable into and out of contact with the valve component seating area, wherein the movable valve part includes at least a portion made from a magnetic attractable material; (d) a first magnet located outside the interior chamber of the fluid line; and (e) means for controlling a strength of a magnetic field incident on the movable valve part (e.g., by varying a physical distance between the magnet and the movable valve part, by changing a current setting of an electromagnet, by changing magnets, etc.). Such fluid flow control systems may allow the crack pressure of the valve (formed at least by the fixed valve part and the movable valve part) to be modified, changed, and/or controlled. The fluid flow control systems may be incorporated into an article of footwear (e.g., into a sole structure, upper, and/or other component for an article of footwear).

Some aspects of this invention relate to methods of adjusting crack pressure of a check valve. Such methods may include providing a check valve including: (a) a fluid line having a first end and a second end opposite the first end, wherein the fluid line defines an interior surface extending between the first end and the second end, wherein the interior surface defines an interior chamber through which fluid will flow; (b) a fixed valve part sealingly engaged with the interior surface of the fluid line, wherein the fixed valve part includes a valve component seating area; (c) a movable valve part movable into and out of contact with the valve component seating area, wherein the movable valve part includes at least a portion made from a magnetic attractable material; and (d) a biasing component that applies a biasing force to the movable valve part in a direction toward the valve component seating area. In a first configuration, the movable valve part of this check valve is exposed to a first magnetic field strength to set a first crack pressure at which the movable valve part will unseat from the valve component seating area and allow fluid to flow from the first end to the second end. Then, the first configuration is changed to a second configuration in which the first magnetic field strength is changed to a second magnetic field strength that is different from the first magnetic field strength. This change exposes the movable valve part to the second magnetic field strength and changes the check valve crack pressure from the first crack pressure to a second crack pressure at which the movable valve part will unseat from the valve component seating area and allow fluid to flow from the first end to the second end, and the second crack pressure will be different from the first crack pressure. Other changes to the magnetic field strength can be used to set additional different crack pressure levels. The magnetic field strength can be changed in any desired manner, including for example: changing a physical location of a magnet (e.g., a permanent magnet) with respect to the movable valve part (e.g., by moving the magnet along a track, rotating the magnet with a dial, etc.); replacing one magnet with different magnet of different magnetic fields strength; changing an amount (e.g., a thickness) or type of shielding material located between a magnet and the movable valve part; changing current to an electromagnet; etc.

Still additional aspects of this invention relate to methods of setting foot support pressure for a shoe sole that include:

(1) measuring a first pressure of a first foot support fluid-filled bladder of a first sole of a pair of shoe soles;

(2) measuring a pressure of a second foot support fluid-filled bladder of a second sole of the pair of shoe soles, wherein the second foot support fluid-filled bladder is connected to a fluid source via an adjustable valve having: (a) a fixed valve part including a valve component seating area, and (b) a movable valve part including a portion movable into and out of contact with the valve component seating area, wherein the movable valve part includes at least a portion made from a magnetic attractable material; and (3) determining at least one of a magnetic field strength, a magnet physical location with respect to the movable valve part, or a current supplied to an electromagnet necessary to set a crack pressure of the adjustable valve at a value to maintain foot support pressure of the second foot support fluid-filled bladder at a second pressure that is within a predetermined range from the first pressure.

These aspects of the invention may be extended to methods of setting foot support pressures for a pair of shoe soles that include:

(1) measuring a first pressure of a first foot support fluid-filled bladder of a first sole of the pair of shoe soles, wherein the first foot support fluid-filled bladder is connected to a first fluid source via a first adjustable valve having: (a) a first fixed valve part including a first valve component seating area, and (b) a first movable valve part including a first portion movable into and out of contact with the first valve component seating area, wherein the first movable valve part includes a first portion made from a magnetic attractable material;

(2) measuring a second pressure of a second foot support fluid-filled bladder of a second sole of the pair of shoe soles, wherein the second foot support fluid-filled bladder is connected to a second fluid source via a second adjustable valve having: (a) a second fixed valve part including a second valve component seating area, and (b) a second movable valve part including a second portion movable into and out of contact with the second valve component seating area, wherein the second movable valve part includes a second portion made from a magnetic attractable material;

(3) determining at least one of a first magnetic field strength, a first magnet physical location with respect to the first movable valve part, or a first current supplied to a first electromagnet necessary to set a first crack pressure of the first adjustable valve at a value to maintain the first foot support fluid-filled bladder within a first predetermined range of a first foot support pressure; and (4) determining at least one of a second magnetic field strength, a second magnet physical location with respect to the second movable valve part, or a second current supplied to a second electromagnet necessary to set a second crack pressure of the second adjustable valve at a value to maintain the second foot support fluid-filled bladder within a second predetermined range, optionally within a second predetermined range of the first foot support pressure.

Given the general description of features, aspects, structures, processes, and arrangements according to certain embodiments of the invention provided above, a more detailed description of specific example fluid flow control systems, foot support structures, articles of footwear, and methods in accordance with this invention follows.

II. Detailed Description of Example Articles of Footwear, Foot Support Systems, Fluid Flow Control Systems, and Other Components/Features According to this Invention Referring to the figures and following discussion, various examples of fluid flow control devices and foot support systems according to aspects of this invention are described. Aspects of this invention may be used in conjunction with foot support systems, articles of footwear (or other foot-receiving devices), and/or methods described in U.S. Provisional Patent Appln. No. 62/463,859, U.S. Provisional Patent Appln. No. 62/463,892, and/or U.S. Provisional Patent Appln. No. 62/547,941. As some more specific examples, fluid flow control devices of the types described herein may be used, for example, as at least part of one or more of fluid flow control systems 108, controlled valves/switches 108S, 108A, stops 108B, 108M, and/or input systems 1081 as described in U.S. Provisional Patent Appln. No. 62/463,859 and/or U.S. Provisional Patent Appln. No. 62/463,892 and/or as at least part of one or more of the valves described in U.S. Provisional Patent Appln. No. 62/547,941. Each of U.S. Provisional Patent Appln. No. 62/463,859, U.S. Provisional Patent Appln. No. 62/463,892, and U.S. Provisional Patent Appln. No. 62/547,941, and particularly the descriptions of the various parts described above, is entirely incorporated herein by reference.

FIGS. 1A-1E provide schematic views of foot support systems 100 for articles of footwear 1000-5000 in accordance with examples of this invention. The articles of footwear 1000-5000 may include an upper 1002, e.g., made from one or more component parts, including conventional footwear upper parts as are known and used in the footwear arts. The upper 1002 may be engaged with a sole structure 1004, which also may be made from one or more component parts, including conventional footwear sole structure parts as are known and used in the footwear arts (e.g., midsoles, outsoles, etc.). Any of footwear upper 1002, footwear sole structure 1004, a component part thereof, and/or any combination of component parts of an article of footwear may be referred to herein as a "footwear component" and identified by reference number 1010.

FIG. 1A schematically illustrates an article of footwear 1000 having a foot support system 100 engaged with a footwear component 1010 for the article of footwear 1000. The foot support system 100 of this example includes a first fluid container 102 (e.g., a fluid-filled bladder or other container) engaged with the first footwear component 1010. This first fluid container 102, which may constitute a fluid-filled bladder for supporting all or some portion of a wearer's foot, includes a gas at a first pressure.

The foot support system 100 of this example further includes a second fluid container 104, e.g., engaged with the same footwear component 1010 or a different footwear component. This second fluid container 104 may constitute a fluid-filled bladder, optionally for supporting at least a portion of a wearer's foot. Additionally or alternatively, the second fluid container 104 may constitute a reservoir or accumulator that can supply gas to first fluid container 102 and accept gas from first fluid container 102 to enable changes of pressure in the first fluid container 102 (and in second fluid container 104). The second fluid container 104 includes a gas at a second pressure, and this second pressure may be the same or different from the first pressure.

A first fluid transfer line 106 places the first fluid container 102 in fluid communication with the second fluid container 104. This first fluid transfer line 106 may constitute plastic tubing, e.g., engaged with or integrally formed with one or both of fluid container 102 and/or fluid container 104. A flow regulator 120 is provided in or otherwise connected to the first fluid transfer line 106. This flow regulator 120 includes at least one valve 140. Flow regulator 120 and valve 140 are switchable between: (a) an open condition in which fluid flows through the flow regulator 120/valve 140 and through the first fluid transfer line 106 and (b) a closed condition in which fluid flow through the first fluid transfer line 106 is stopped by the flow regulator 120/valve 140. More specific examples and details of the flow regulator 120/valve 140 structure and operation are described below in conjunction with FIGS. 3A-4C.

This example article of footwear 1000 further includes a control system 160 configured to change the flow regulator 120/valve 140 between the open condition and the closed condition. While other options are possible, in this illustrated example article of footwear 1000, the control system 160 includes a magnet 162 that is movable from a first position 164 (also called an "activation position" herein) to a second position 166 (shown in broken lines and also called a "deactivation position" herein). The magnet 162 may be mounted on a movable (e.g., rotatable or otherwise movable) base 168 that moves the magnet 162 between the first position 164 and the second position 166. The movable base 168 could be a manually operated switch (e.g., a rotary dial type switch, etc.) or an electronically controlled device (movable under commands sent by an electronic input system 170, such as a cellular telephone app or other electronic device).

When at the first position 164, the magnet 162 may interact with a part of the flow regulator 120 and/or valve 140, e.g., to hold at least a portion of the flow regulator 120 and/or valve 140 in a position to create and maintain the open condition. When at the second position 166, the magnet 162 may be sufficiently removed from the part of the flow regulator 120 and/or valve 140 with which it can interact to allow the flow regulator 120 and/or valve 140 to be placed and maintained in the closed condition (e.g., in response to a biasing force on at least part of the flow regulator 120 and/or valve 140). Examples of changing the flow regulator 120 and/or valve 140 between the open condition and the closed condition will be discussed in more detail below in conjunction with FIGS. 3A-4C.

In at least some example systems and methods according to aspects of this invention, when the second pressure (in the second fluid container 104) is greater than the first pressure (in the first fluid container 102), the control system 160: (a) holds the flow regulator 120/valve 140 in the closed condition and inhibits gas from moving from the second fluid container 104, through the first fluid transfer line 106 and flow regulator 120/valve 140, and into the first fluid container 102 (e.g., the control system magnet 162 may be at deactivation position 166 to stop the fluid flow) or (b) is selectively controllable to move the flow regulator 120/valve 140 to the open condition and allow fluid to move from the second fluid container 104, through the first fluid transfer line 106 and flow regulator 120/valve 140, and into the first fluid container 102 (e.g., the control system magnet 162 may be at activation position 164 to allow this fluid flow to occur). If the control system 160 holds the flow regulator 120 and/or valve 140 in the open condition for a sufficient period of time (e.g., with the magnet 162 at activation position 164), pressure may be equalized between the first fluid container 102 and the second fluid container 104 in some examples of this invention (i.e., the first pressure may equal the second pressure). When the first pressure in the first fluid container 102 is greater than the second pressure in the second fluid container 104 by at least a first predetermined amount, flow regulator 120 and/or valve 140 may operate as a check valve to allow fluid to flow from the first fluid container 102 to the second fluid container 104 through flow regulator 120/valve 140 and fluid transfer line 106, as will be described in more detail below.

Figure 1B:
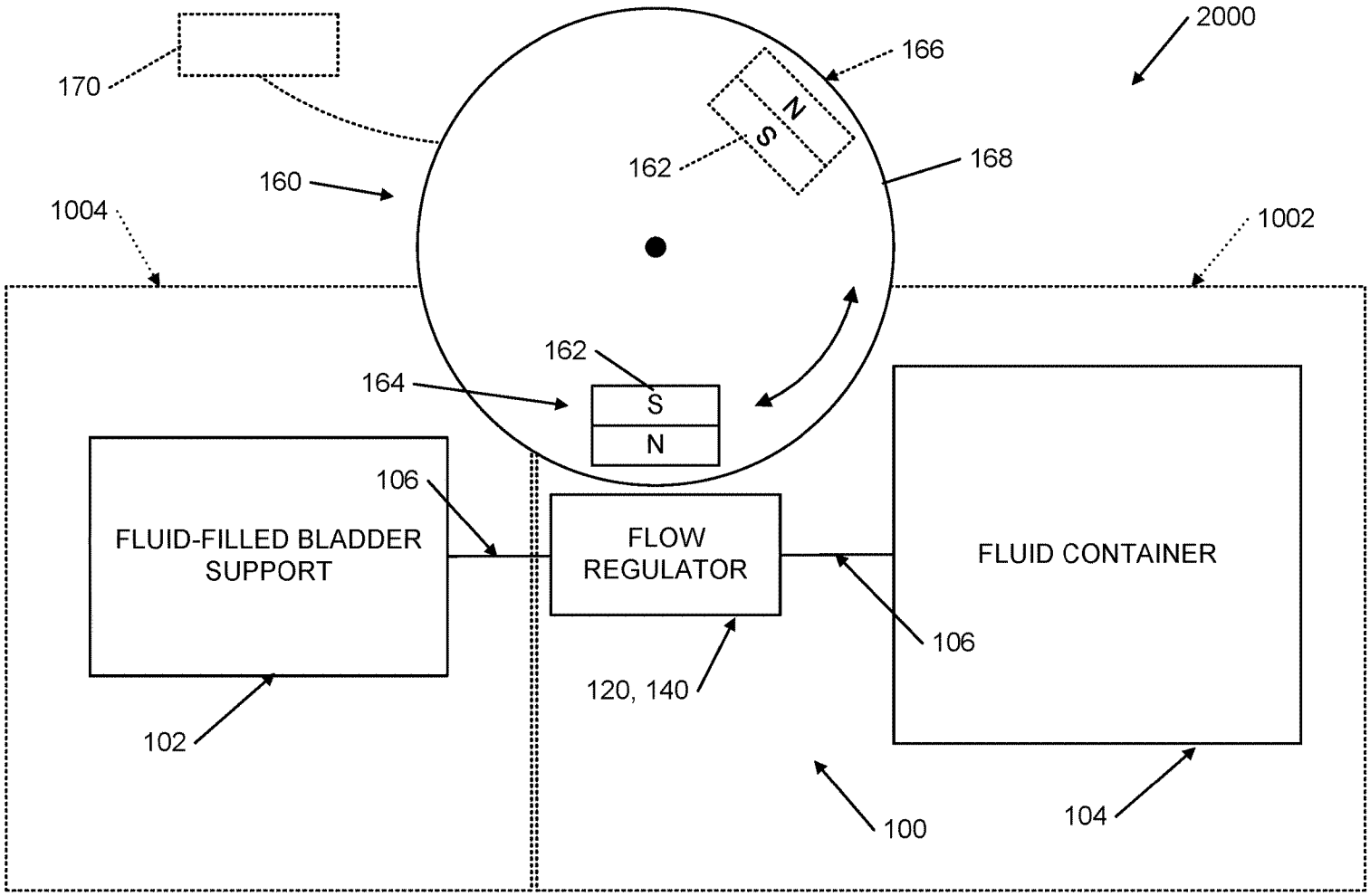

FIG. 1B shows another example of an article of footwear 2000 configuration in accordance with some examples of this invention. In this illustrated example, the first fluid container 102 constitutes a fluid-filled bladder foot support that is engaged with or provided as part of the sole structure 1004 of article of footwear 2000. This foot support bladder (and those described below) may support all or any desired portion(s) of a plantar surface of a wearer's foot. The second fluid container 104, which also may be (but is not necessarily) a fluid-filled bladder, is engaged with or provided as part of an upper 1002 of the article of footwear 2000. While the flow regulator 120/valve 140 is shown engaged with the upper 1002 in this schematic, if desired, all or some parts of flow regulator 120 and/or valve 140 may be engaged with the sole structure 1004. All or part of the control system 160 may be engaged with the upper 1002 and/or the sole structure 1004 in this illustrated example. The system of FIG. 1B may take on a physical construction like those illustrated in FIGS. 1A and 1B in U.S. Provisional Patent Appln. No. 62/463,859 and U.S. Provisional Patent Appln. No. 62/463,892.

Figure 1C:
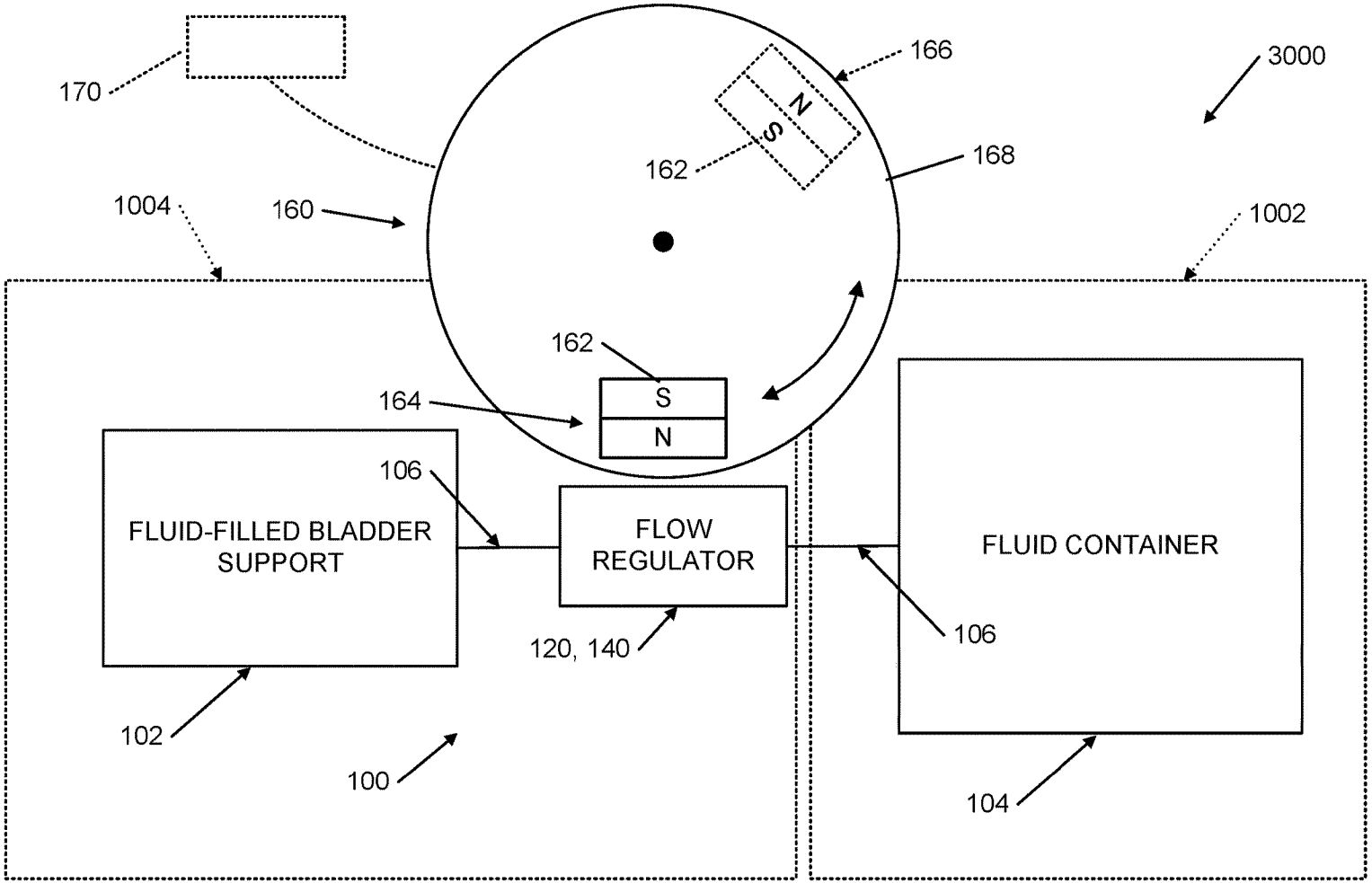

Another example article of footwear 3000 configuration is shown in FIG. 1C. In this example footwear 3000 structure, the first fluid container 102 constitutes a fluid-filled bladder foot support that is engaged with or provided as part of the sole structure 1004 of article of footwear 3000. The second fluid container 104, which also may be (but is not necessarily) a fluid-filled bladder, is engaged with or provided as part of an upper 1002 of the article of footwear 3000. The flow regulator 120/valve 140 is shown engaged with the sole structure 1004 in this schematic (although all or some parts of it, if desired, may be engaged with the upper 1002). All or part of the control system 160 of this example is engaged with the sole structure 1004.

Figure 1D:
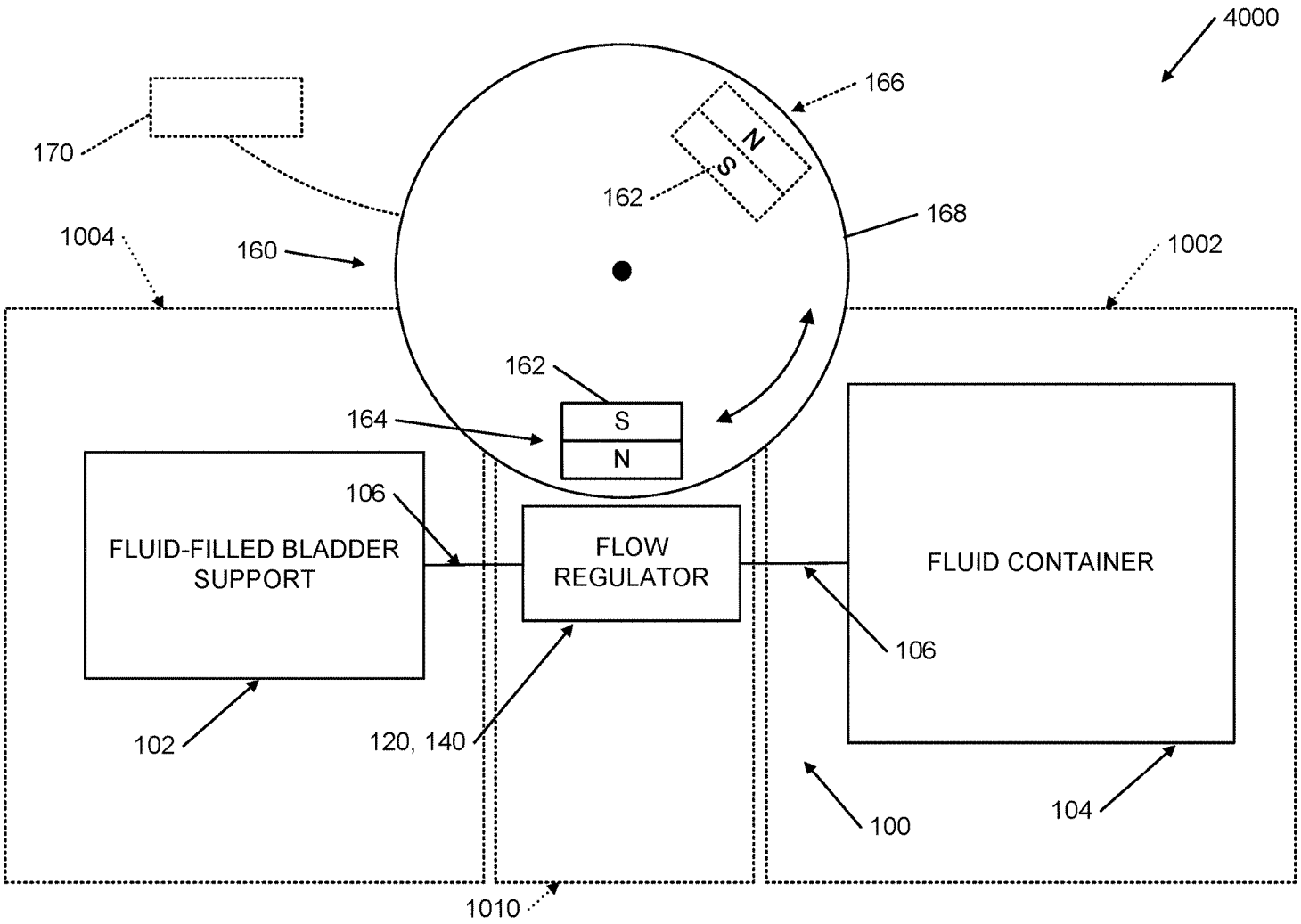

The example article of footwear 4000 structure shown in FIG. 1D is similar to that of FIGS. 1B and 1C in that: (a) the first fluid container 102 constitutes a fluid-filled bladder foot support that is engaged with or provided as part of the sole structure 1004 of article of footwear 4000 and (b) the second fluid container 104, which also may be (but is not necessarily) a fluid-filled bladder, is engaged with or provided as part of an upper 1002 of the article of footwear 4000. In this example footwear 4000 structure, however, the flow regulator 120/valve 140 and/or control system 160 structures is/are provided on a footwear component 1010 different from those with which the first fluid container 102 and the second fluid container 104 are engaged. As an example, if desired, all or some portion(s) of the flow regulator 120/valve 140 and/or control system 160 structures may be provided on a tongue component for the article of footwear 4000 (which may be considered to be part of the upper 1002, but a different part than that with which the second fluid container 104 is engaged).

Figure 1E:
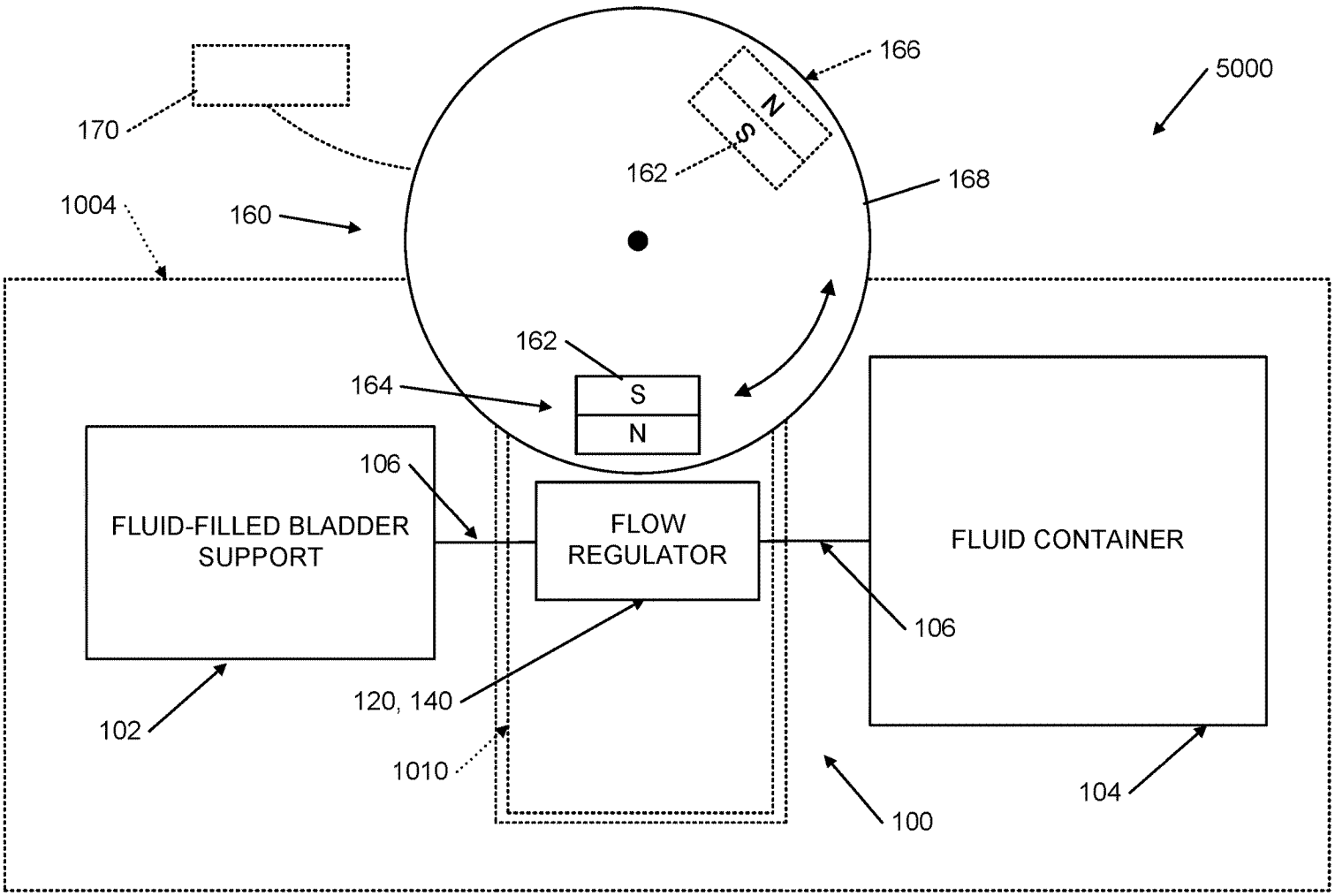

FIG. 1E schematically shows another example article of footwear 5000 configuration in accordance with some examples of this invention. In this illustrated example, the first fluid container 102 constitutes a fluid-filled bladder foot support that is engaged with or provided as part of the sole structure 1004 of article of footwear 5000. The second fluid container 104, which also may be (but is not necessarily) a fluid-filled bladder, also is engaged with or provided as part of the sole structure 1004 of the article of footwear 5000. The flow regulator 120/valve 140 and/or control system 160 of this example is/are shown engaged with another footwear component 1010, which may constitute an upper 1002 for the article of footwear 5000 and/or a different sole structure component. The system of FIG. 1E may take on physical constructions like those illustrated in FIGS. 2A-2F in U.S. Provisional Patent Appln. No. 62/463,859 and U.S. Provisional Patent Appln. No. 62/463,892.

Figure 2:
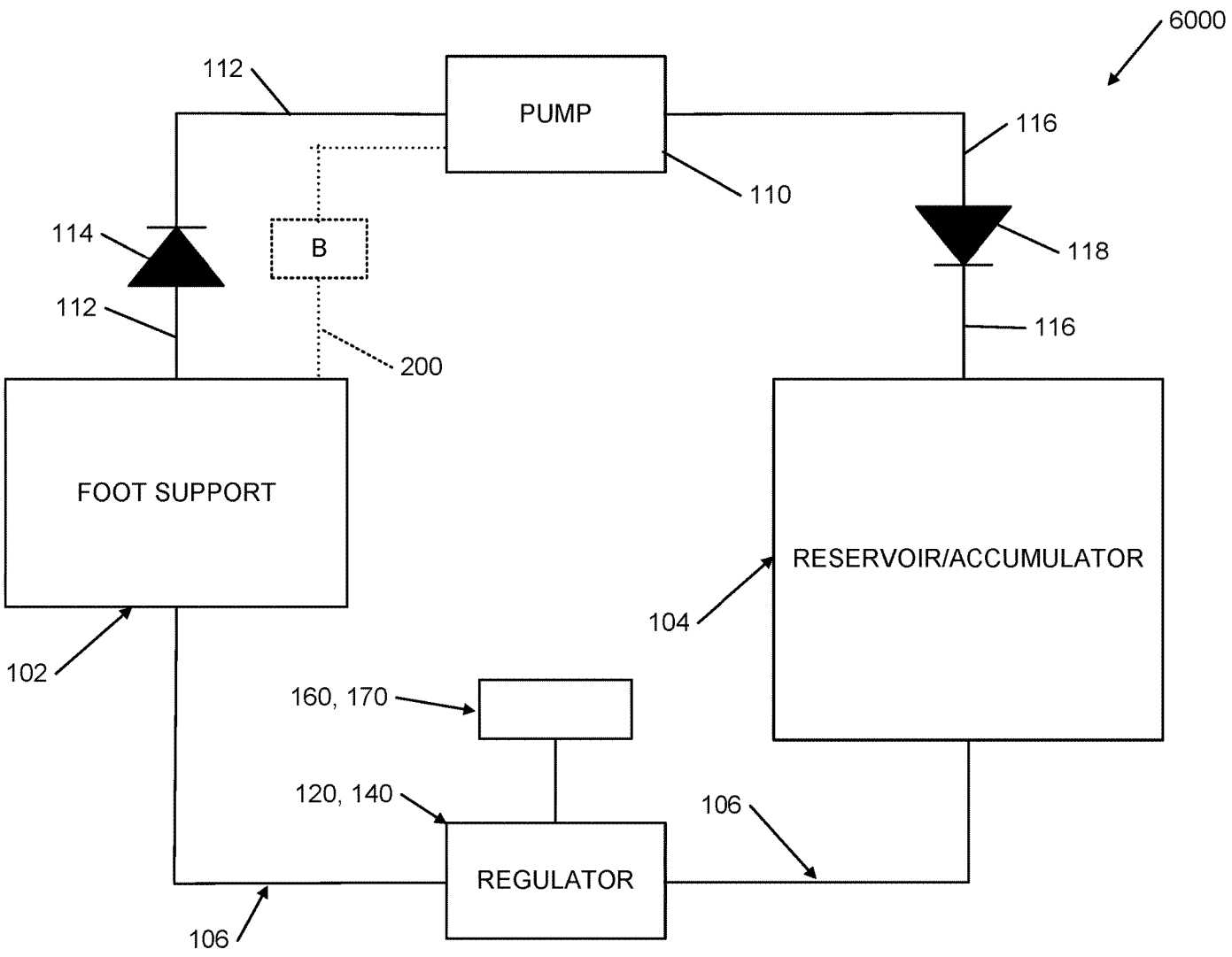
FIG. 2 illustrates a foot support system for an article of footwear that moves fluid between various fluid containers in accordance with examples of this invention.

FIG. 2 schematically illustrates a foot support system 6000 in accordance with some examples of this invention. The foot support fluid-filled bladder 102, reservoir/accumulator fluid container (which also may be (but is not necessarily) a fluid-filled bladder) 104, fluid transfer line 106, flow regulator 120, valve 140, control system 160, and input system 170 may have any of the structures, features, characteristics, and options for those parts as described above (and as described in more detail below). Therefore, much of the repetitive description of these commonly shown parts will be omitted from this description of FIG. 2.

As shown in FIG. 2, in this foot support system 6000, the foot support fluid-filled bladder 102 is engaged with a pump 110, which may be a foot-activated pump 110 (activated by a wearer's heel or toe(s)), via fluid transfer line 112. A valve 114 (e.g., a one-way valve) in fluid transfer line 112 allows fluid to transfer from the foot support fluid-filled bladder 102 to the pump 110 via fluid transfer line 112, but the valve 114 does not permit fluid to move from pump 110 to foot support bladder 102 via fluid transfer line 112. The pump 110 is in fluid communication with fluid container 104 (e.g., a fluid-filled bladder that serves as a reservoir or accumulator for fluid) via fluid transfer line 116. Another valve 118 (e.g., a one-way valve) in line 116 allows fluid to transfer from the pump 110 to the second fluid container 104 via fluid transfer line 116, but the valve 118 does not permit fluid to move from second fluid container 104 to the pump 110 via fluid transfer line 116. Fluid transfer line 106 enables movement of fluid between the fluid container 104 and the fluid-filled bladder support 102 through and/or under the control of fluid flow regulator 120/valve 140, control system 160, and/or input system 170. The foot support system 6000 illustrated in FIG. 2 is a closed system (meaning it is not structured to intake new gas from the external environment and does not release gas to the external environment, although a closed system is not required in all examples of this invention). Fluid is moved into and out of fluid container 104 and foot support bladder 102 to change the pressure in the foot support bladder 102 and its underfoot feel to the wearer. Foot support system 6000 could take on any of the various structures and/or operations described in conjunction with FIGS. 3A-4C of U.S. Provisional Patent Appln. No. 62/463,859 and U.S. Provisional Patent Appln. No. 62/463,892.

In use, pump 110 (which may be a foot-compressible "bulb" type pump) moves fluid from the foot support fluid-filled bladder 102 to the reservoir bladder 104 in response to a wearer's steps. Depending on the characteristics, features, and/or settings of valves 114, 118; fluid flow regulator 120/valve 140; control system 160; and/or input system 170, fluid can be moved between foot support fluid-filled bladder 102 and fluid container 104 to set and maintain the gas pressure in foot support fluid-filled bladder 102 at a desired level. The fluid flow regulator 120/valve 140 of this example:

(a) can operate as a stop valve to stop transfer of fluid between reservoir fluid-filled container 104 and foot support fluid-filled bladder 102 via line 106, (b) can open in a controlled manner (via control system 160 and/or input system 170) to allow transfer of fluid from reservoir fluid-filled container 104 to foot support fluid-filled bladder 102 via line 106 to change pressure in the foot support fluid-filled bladder 102, (c) can open to equalize pressure in reservoir fluid-filled container 104 and foot support fluid-filled bladder 102, and (d) can act as a check valve to enable flow of fluid from foot support fluid-filled bladder 102 to the reservoir fluid-filled container 104, e.g., if gas pressure in the foot support fluid-filled bladder 102 exceeds gas pressure in the reservoir fluid-filled container 104, e.g., by a first predetermined pressure differential amount (e.g., if the first pressure in foot support fluid-filled bladder 102 is 5 psi or more than the second pressure in the fluid-filled container 104).

This example fluid flow regulator 120/valve 140 structure could be provided in the fluid transfer line(s) between foot support 102 and reservoir accumulator 104 in the various embodiments and example structures shown in U.S. Provisional Patent Appln. No. 62/463,859 and U.S. Provisional Patent Appln. No. 62/463,892 (e.g., note FIGS. 3A-3F therein). Additionally or alternatively, if desired, this type of fluid flow regulator 120/valve 140 structure (optionally along with the same or different control system 160 and/or input device 170) could be provided as valve 114 in line 112 and/or as valve 118 in line 116 of FIG. 2. As yet another example or alternative feature, this type of fluid flow regulator 120/valve 140 structure (optionally along with the same or different control system 160 and/or input device 170) could be provided in a fluid transfer line 200 provided between pump 110 and foot support fluid-filled bladder 102, shown in broken lines at location "B" in FIG. 2.

Figure 3A:
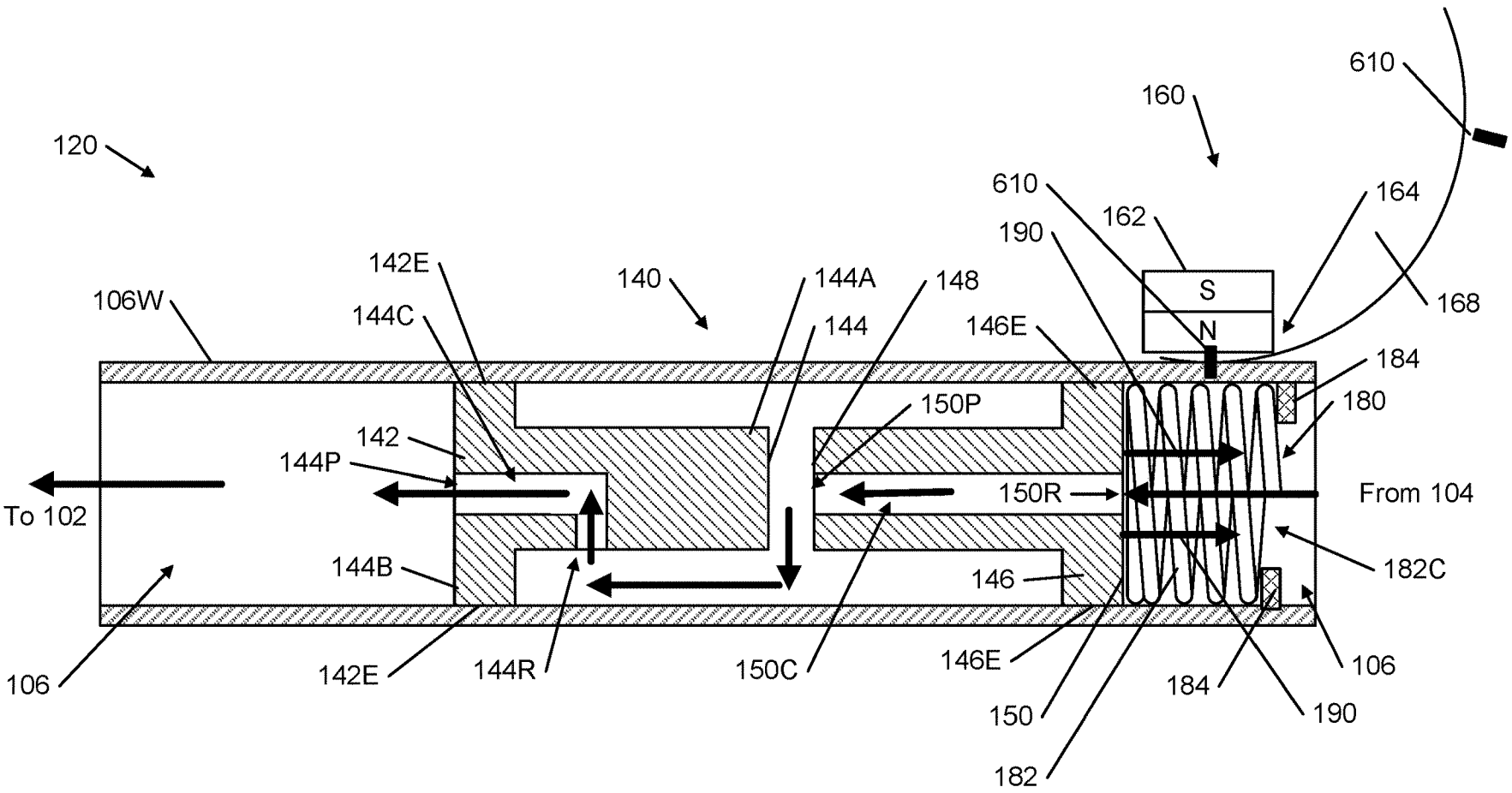
FIGS. 3A-3D illustrate fluid flow controllers and valve structures in accordance with some examples of this invention in various operational configurations.
Figure 3B:
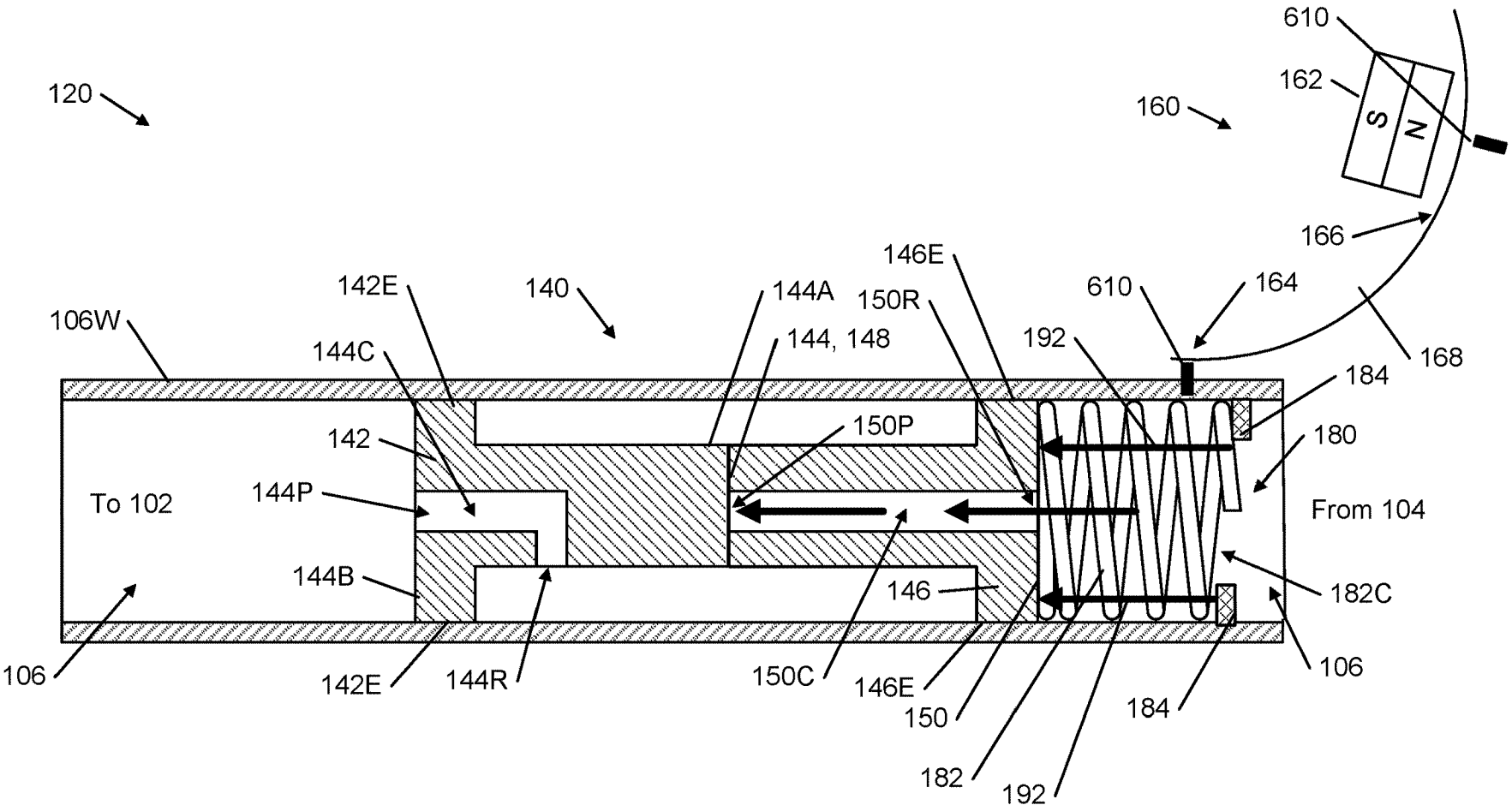
Figure 3C:
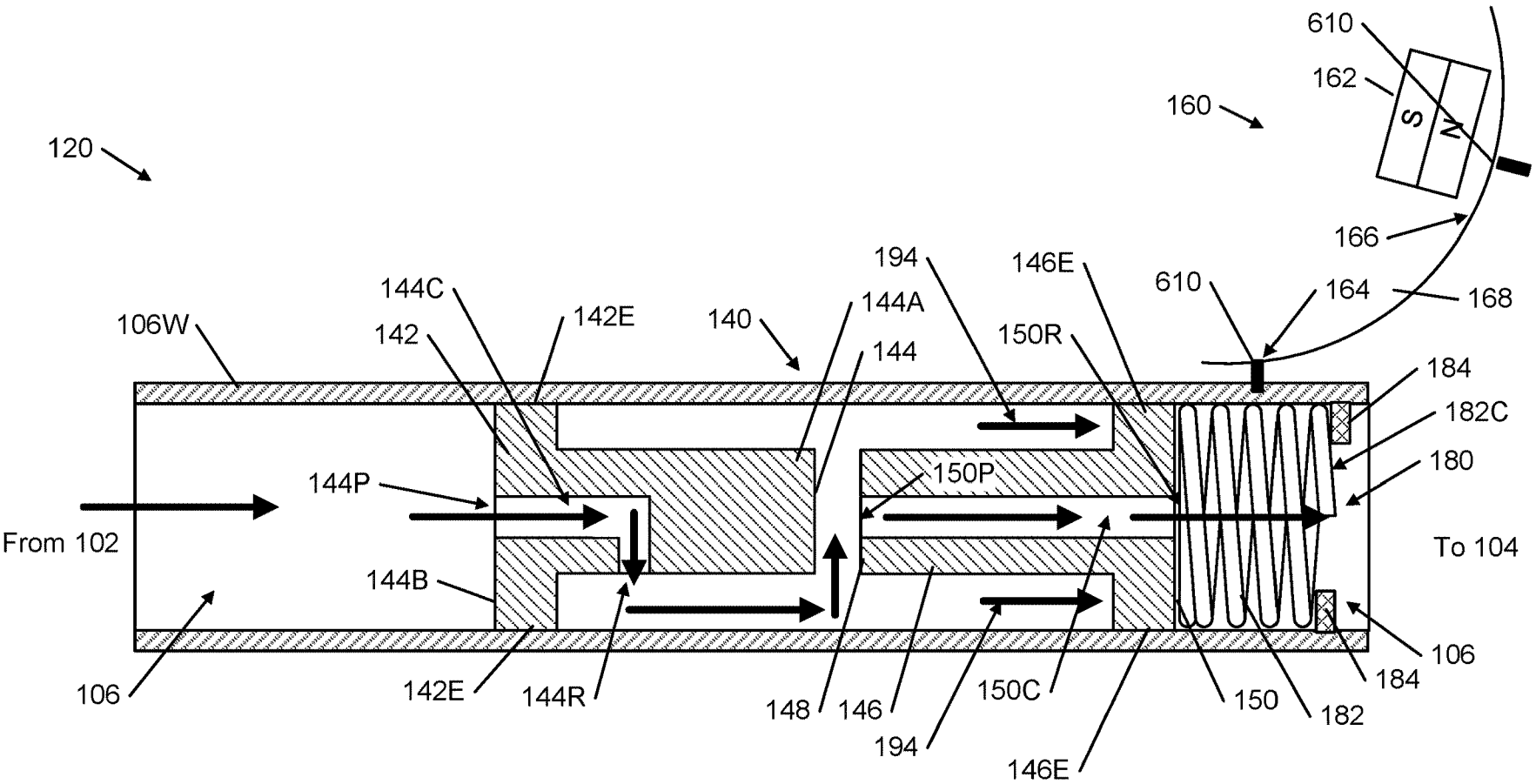

Structures and operational features of various examples of fluid flow regulators 120 and/or valves 140 in accordance with aspects of this invention now will be described in conjunction with FIGS. 3A-4C. A first example fluid flow controller 120 with a valve 140 is shown in FIGS. 3A-3C. FIG. 3A shows the fluid flow controller 120/valve 140 in the open condition in which fluid flows through fluid transfer line 106 from the second fluid container 104 to the first fluid container 102 (e.g., to foot support fluid-filled bladder). FIG. 3B shows the fluid flow controller 120/valve 140 in the closed condition in which fluid flow through fluid transfer line 106 from the second fluid container 104 to the first fluid container 102 is stopped. FIG. 3C shows the fluid flow controller 120/valve 140 in the open condition in a "check valve" configuration in which fluid flow through fluid transfer line 106 from the first fluid container 102 to the second fluid container 104 occurs (e.g., when pressure in the first fluid container 102 exceeds pressure in the second fluid container 104 by a first predetermined pressure differential amount (e.g., 5 psi)). The structure and operation of this example fluid flow controller 120 and valve 140 will be described in more detail below.

As shown in FIG. 3A, in this illustrated example, the valve 140 components are mounted within a tube wall 106W of fluid transfer line 106, which may be in the form of a plastic tube (e.g., a flexible plastic tube that defines an interior fluid flow channel). Alternatively or additionally, if desired, the fluid flow regulator 120/valve 140 could be formed as a separate part from fluid transfer line 106, and one or both ends of flow regulator 120/valve 140 may include a connector structure that connects to ends of a plastic tube or other structure forming the fluid transfer line 106. As other options or alternatives, the fluid flow regulator 120 and/or valve 140 may be otherwise engaged with fluid transfer line 106 by adhesive or cement, by one or more mechanical connectors, by fusing techniques, etc.

The valve 140 of this illustrated example includes a fixed valve part 142 having a valve component seating area 144. The fixed valve part 142 may be fixed to the interior surface of the tube wall 106W and within the tube interior channel (or fixed within a component part of the valve 140), e.g., by a cement or adhesive, a mechanical connector, etc. The side edge(s) 142E of fixed valve part 142 in contact with the interior surface of tube wall 106W form a sealed structure that will not permit fluid to pass between the side edge(s) 142E and the interior surface of the tube wall 106W. This example fixed valve part 142 includes a first end 144A forming a stop surface, and at least a portion of this first end/stop surface forms the valve component seating area 144 (e.g., the first end 144A surface provides the valve component seating area 144). A second end 144B of the fixed valve part 142 located opposite from the first end 144A with the valve seating area 144 includes at least one fluid port 144P. A fluid channel 144C extends through the fixed valve part 142 from the first fluid port 144P to a second fluid port 144R located at an exterior surface of the fixed valve part 142. While FIGS. 3A-3C show the second fluid port 144R located on a side surface of the fixed valve part 142, the fluid ports 144P/144R could be provided on any desired surfaces and/or at any desired locations on the fixed valve part 142, and the fluid channel 144C could extend through the fixed valve part 142 in any desired direction or path (provided the desired functions can be supported). Also, if desired, more than one fluid channel 144C, more than one inlet port, and/or more than one outlet port could be provided through fixed valve part 142.

A movable valve part 146 (also called a "shuttle") also is provided within the tube wall 106W (or within a component part of the valve 140). This movable valve part 146 includes a portion 148 (e.g., an end surface) movable into and out of contact with the valve component seating area 144 of the fixed valve part 142, as can be seen by a comparison of FIGS. 3A and 3C with FIG. 3B (and as explained in more detail below). The side edge(s) 146E of the movable valve part 146 of this example are sized and shaped to contact the interior surface of tube wall 106W and are slidingly disposed or otherwise movable with respect to the interior surface of tube wall 106W while maintaining a sealed connection between side edge(s) 146E and tube wall 106W. Additionally or alternatively, another seal may be provided, e.g., inside tube wall 106W and separate from the movable valve part 146, to prevent fluid leakage around or past movable part 146. If necessary or desired, the facing/contacting surfaces of the side edge(s) 146E of the movable valve part 146 and/or the interior surface of the tube wall 106W may be formed of or treated by a lubricant material (e.g., a polytetrafluoroethylene PTFE material) to facilitate the desired motion and/or may be formed of or treated by material(s) to support or promote the sliding and sealed engagement. Additionally or alternatively, if desired, either or both of the valve seating area 144 and/or the portion 148 of the movable valve part 146 that moves into and out of contact with the valve seating area 144 may include a material to enhance sealing between the valve seating area 144 and the portion 148 of the movable valve part 146 (e.g., including one or more rubberized sealing surfaces, made from a soft/compressible material, etc.). At least some portion (and optionally all) of the movable valve part 146 may be made from a magnetically attractable material, such as a magnet, a magnetizable material, a ferromagnetic material, iron, etc., e.g., for reasons described in more detail below.

The movable valve part 146 of this example includes: (a) a free end surface that forms the portion 148 movable into and out of contact with the valve component seating area 144 and (b) an opposite end surface 150. An open channel 150C extends through the movable valve part 146 from one port 150P or opening located at the free end surface 148 and another port 150R located at the other end surface 150 of the movable valve part 146. While FIGS. 3A-3C show the two fluid ports 150P and 150R located along a central longitudinal axis of the movable valve part 146 (and a central, axial channel 150C), the fluid ports 150P/150R could be provided on any desired surfaces and/or at any desired locations on the movable valve part 146, and the fluid channel 150C could extend through the movable valve part 146 in any desired direction or path. Also, if desired, more than one fluid channel 150C, more than one inlet port, and/or more than one outlet port could be provided through movable valve part 146.

The fluid flow controller 120/valve 140 of this illustrated example further includes a biasing component 180 for holding the movable valve part 146 in a "default" position so that the valve 140/fluid flow controller 120 will maintain one of an open condition (e.g., as shown in FIG. 3A) or a closed condition (e.g., as shown in FIG. 3B) when no other external forces act on the movable valve part 146. In the embodiment of FIGS. 3A-3C, the biasing component 180 includes a spring 182 positioned at the end 150 of the movable valve part 146 located opposite from the end including the portion 148 that moves into and out of contact with the valve component seating area 144. The spring 182 of this example is located at least partially within the interior chamber formed by the tube wall 106W and extends between a fixed member 184 or other fixed connection and the end surface 150 of the movable valve part 146. The central axis of the spring 182 (or other biasing component) may include an open channel 182C through which fluid can flow to reach the port 150R and movable valve part 146.

In the absence of external forces, the biasing component 180 of this illustrated example fluid flow controller 120/valve 140 is configured and arranged to push the movable valve part 146 tightly against the fixed valve part 142, e.g., in the arrangement shown in FIG. 3B. The biasing force of the spring 182 is shown by force arrows 192 in FIG. 3B. In this manner, the free end 148 of the movable valve part 146 is moved into contact with the stop surface and valve seating area 144 of the fixed valve part 142. If necessary or desired, valve seating area 144 of the fixed valve part 142 and/or free end 148 of the movable valve part 146 may be made from a material and/or treated to enhance a sealing effect when these parts contact one another. This contacting or closed configuration closes the fluid path through the fluid flow controller 120/valve 140 and stops fluid flow at the port 150P/valve seating area 144 location as shown in FIG. 3B.

In this configuration of FIG. 3B, the magnet 162 is positioned at location 166 (the deactivation position) and away from the fluid flow controller 120/valve 140, as shown in FIG. 3B (and by broken lines in FIGS. 1A-1E). This may be accomplished, for example, by turning dial base 168 to rotate the magnet 162 a sufficient distance away from movable valve part 146 (which may be made at least in part from a magnet or a material that is attracted to a magnet) so that any magnetic attraction force between the magnet 162 and the movable valve part 146 is overcome by the biasing force 192 of the spring 182 (or other biasing component). As an alternative, if magnet 162 is an electromagnet instead of a permanent magnet, in the closed configuration of FIG. 3B, the electromagnet may be in a powered off (or other lower power) condition. As yet another alternative, some type of intervening shield material may be positionable (e.g., moved by/with base 168) between magnet 162 and movable valve part 146 to stop/attenuate magnetic attraction between these parts.

To change the pressure in the foot support bladder 102 (or other fluid container), starting with the fluid flow regulator 120/valve 140 in the closed configuration shown in FIG. 3B, first the control system 160 is controlled to move the magnet 162 into activation position 164 to apply a stronger magnetic attraction force to movable valve part 146. This may be accomplished, for example, by rotating a dial (e.g., or otherwise moving base 168), moving an intervening shield, entering input into an electronic input device 170 (e.g., such as a cellular telephone application program), powering on (or increasing power to) an electromagnet (manually or electronically), etc. When the magnet 162 is in the activation position 164, magnetic attraction between the magnet 162 and the movable valve part 146 overcomes the biasing force 192 of biasing component 180 (e.g., spring 182) to pull end 148 of the movable valve part 146 away from the valve seating area 144 of the fixed valve part 142. This pulling force on the movable valve part 146 is shown by force arrow 190 in FIG. 3A. The magnetic field/magnetic force 190 overcomes the spring 182 force 192 to hold the valve 140/flow controller 120 open. When gas pressure in the second fluid container 104 (e.g., a fluid reservoir bladder) is greater than the pressure in the first fluid container 102 (e.g., a foot support bladder), fluid will flow through spring 182 channel 182C, through channel 150C in the movable valve part 146, out of port 150P, between the movable valve part 146 and the fixed valve part 142 to fluid port 144R, through fixed valve part 142, through port 144P and to the first container 102 (e.g., foot support bladder) via fluid transfer line 106. If the fluid flow controller 120 and/or valve 140 is/are held in this open configuration of FIG. 3A for a sufficient time period, the gas pressure in the first fluid container 102 (e.g., a foot support bladder) will become equal to the gas pressure in the second fluid container 104 (e.g., a reservoir bladder). Thus, fluid flow controller 120 and/or valve 140 can be used in a foot support system 100 to equalize pressure between the foot support bladder 102 and the reservoir accumulator (e.g., bladder) 104 shown in FIG. 2 herein and in various embodiments of the inventions described in U.S. Provisional Patent Appln. No. 62/463,859 and U.S. Provisional Patent Appln. No. 62/463,892.

The movable valve part 146 of this example does not itself include a base-level of magnetic charge or a magnetic bias. Alternatively, if desired, the movable valve part 146 could be magnetized to a desired level, e.g., to enable a manufacturer to change/control the external magnetic field (e.g., from magnet 162) required to open/close the valve 140 and/or to bias the valve 140 in one position or the other in combination with the force of the biasing system 180 (e.g., spring 182).

When fluid pressure is increased in the first container 102 (e.g., foot support bladder) to the desired level (e.g., as measured by a pressure sensor, as determined by a user, etc.), the magnet 162 can be returned to the deactivation position 166, as shown in FIG. 3B. This can be accomplished, for example, by moving the magnet 162 (e.g., rotating or otherwise moving dial and/or base 168), powering off an electromagnet, moving shielding between the magnet 162 and movable valve part 146, entering input into an electronic input device 170, etc. Once in the deactivation position 166 or deactivation condition, the biasing force 192 of the biasing component 180 (e.g., spring 182) will again overcome the magnetic attraction force 190 between magnet 162 and movable valve part 146 to move and hold the movable valve part 146 against the fixed valve part 142 and close/seal the valve 140/fluid flow controller 120 (e.g., seat surface 148 and port 150P of movable valve part 146 against valve seating surface 144 of fixed valve part 142).

FIG. 3C shows the fluid flow controller 120/valve 140 of this example structure in a check valve configuration. In this check valve configuration and operation, if gas pressure in the foot support bladder 102 ever increases above gas pressure in the second fluid container 104 (e.g., a reservoir or accumulator bladder) by at least a predetermined first pressure differential (e.g., 5 psi), the force applied by the gas through fluid transfer line 106 may become high enough to force the movable valve part 146 in a direction to compress the spring 182 (e.g., depending on the spring constant k). In this situation, gas will move from the foot support bladder 102, through channel 144C in the fixed valve part 142 and apply force (e.g. as shown by force arrows 194) to the movable valve part 146. If the force 194 is sufficient, it will unseat surface 148 of the movable valve part 146 from the valve seating surface 144 of the fixed valve part 142 and thereby separate port 150P from valve seating area 144 and open channel 150C through the movable valve part 146. In this manner, fluid can move through the movable valve part 146's channel 150C and into the second fluid container 104 until the force 194 from gas pressure in the foot support bladder 102 is insufficient to overcome the spring 182 biasing force 192. At that time, the fluid flow controller 120/valve 140 will return to the configuration of FIG. 3B. By selecting an appropriate spring constant k for spring 182, the pressure differential between first fluid container 102 and second fluid container 104 sufficient to "crack" the valve 140 into this open check valve configuration can be controlled.

Any desired type of spring(s) 182 and/or other biasing component(s) (e.g., a coil spring; a leaf spring; a resilient component, such as a foam material; etc.) can be used in biasing system 180 without departing from this invention. Additionally or alternatively, if desired, the shapes of the various parts (e.g., fixed valve part 142, movable valve part 146, channel 144C, channel 150C, etc.) may vary widely without departing from this invention.

Figure 3D:
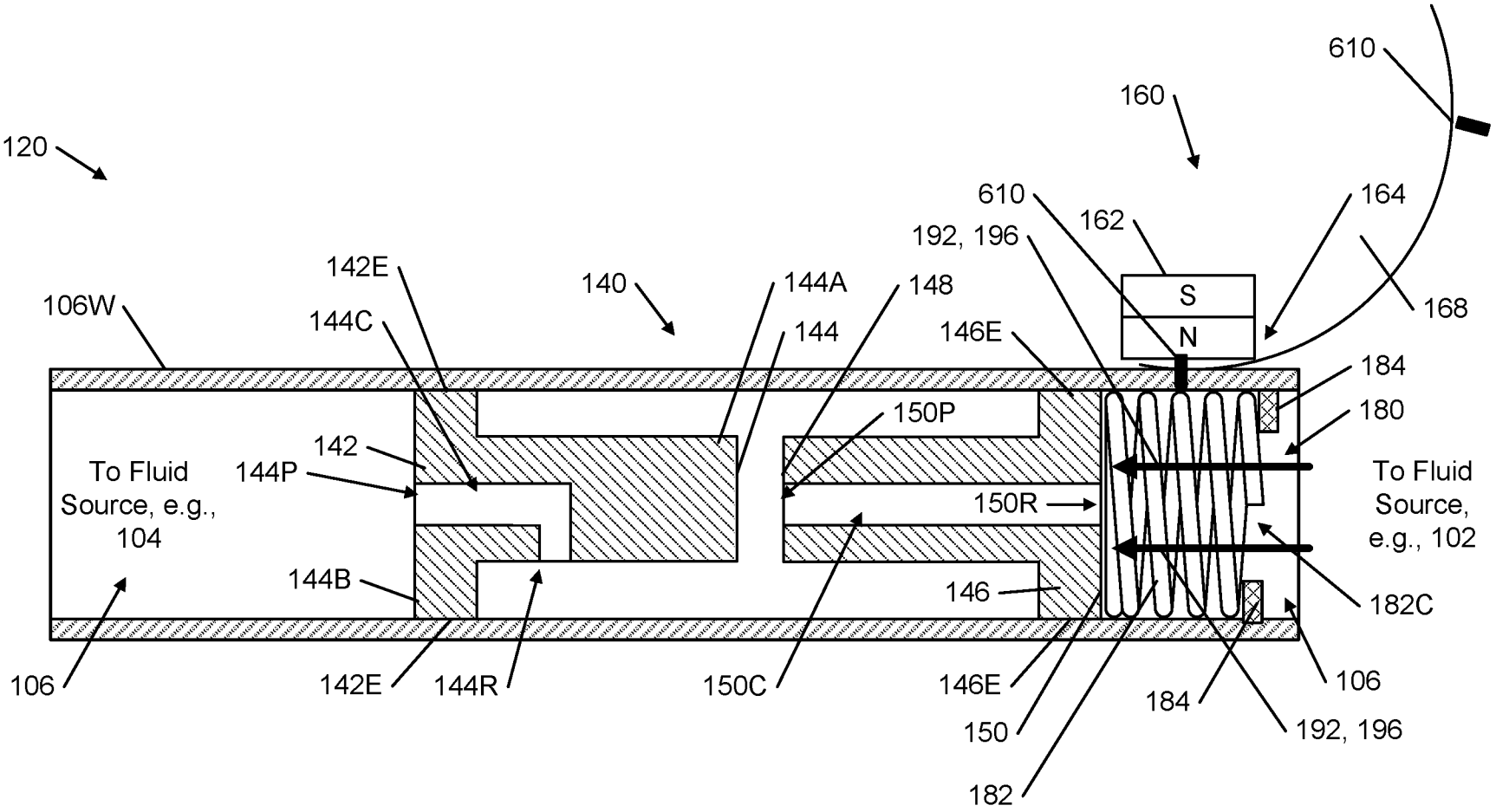

FIG. 3D shows a fluid flow controller 120 having the same structure as shown in FIGS. 3A-3C, but in this example, the fluid flow controller 120 is included in a fluid transfer line 106 shown more generally engaged with "fluid sources." In some examples of this aspect of the invention, this fluid flow controller 120 will be connected to/in fluid communication with: (a) container 104 (e.g., a reservoir container or bladder engaged with a footwear sole structure and/or upper for an article of footwear) at a first end of fluid transfer line 106 (e.g., the left side of FIG. 3D, at the first end of valve 140) and (b) container 102 (e.g., a foot support bladder in a footwear sole structure) at the opposite end of the fluid transfer line 106 (e.g., the right side of FIG. 3D, at the second (opposite) end of valve 140). This arrangement may be advantageous, in at least some examples of this invention, so that impact force between a wearer's foot and the foot support bladder 102 will cause a pressure increase (or pressure impulse force or spike due to the ground contact) that helps more forcefully seat the movable valve part 146 against the valve seating area 144. This may occur, for example, if the added force 196 or force impulse from the fluid pressure pushes against the end surface 150 of the movable valve part 146. The fluid pressure force 196 acts in addition to the force 192 from the biasing system 180, as described above, to even more securely seat the movable valve part 146 with the valve seating area 144. This enhanced valve 140 seating feature as a result of foot strike impulse pressure on the foot support bladder 102 can help assure that the valve 140 remains sealed and closed to prevent pressure loss from the foot support bladder 102 throughout the foot strike event. The fluid flow controller 120 of FIG. 3D can operate as a combined equalizer valve and check valve, opening and closing in the general manners described above in conjunction with FIGS. 3A-3C.

Figure 4A:
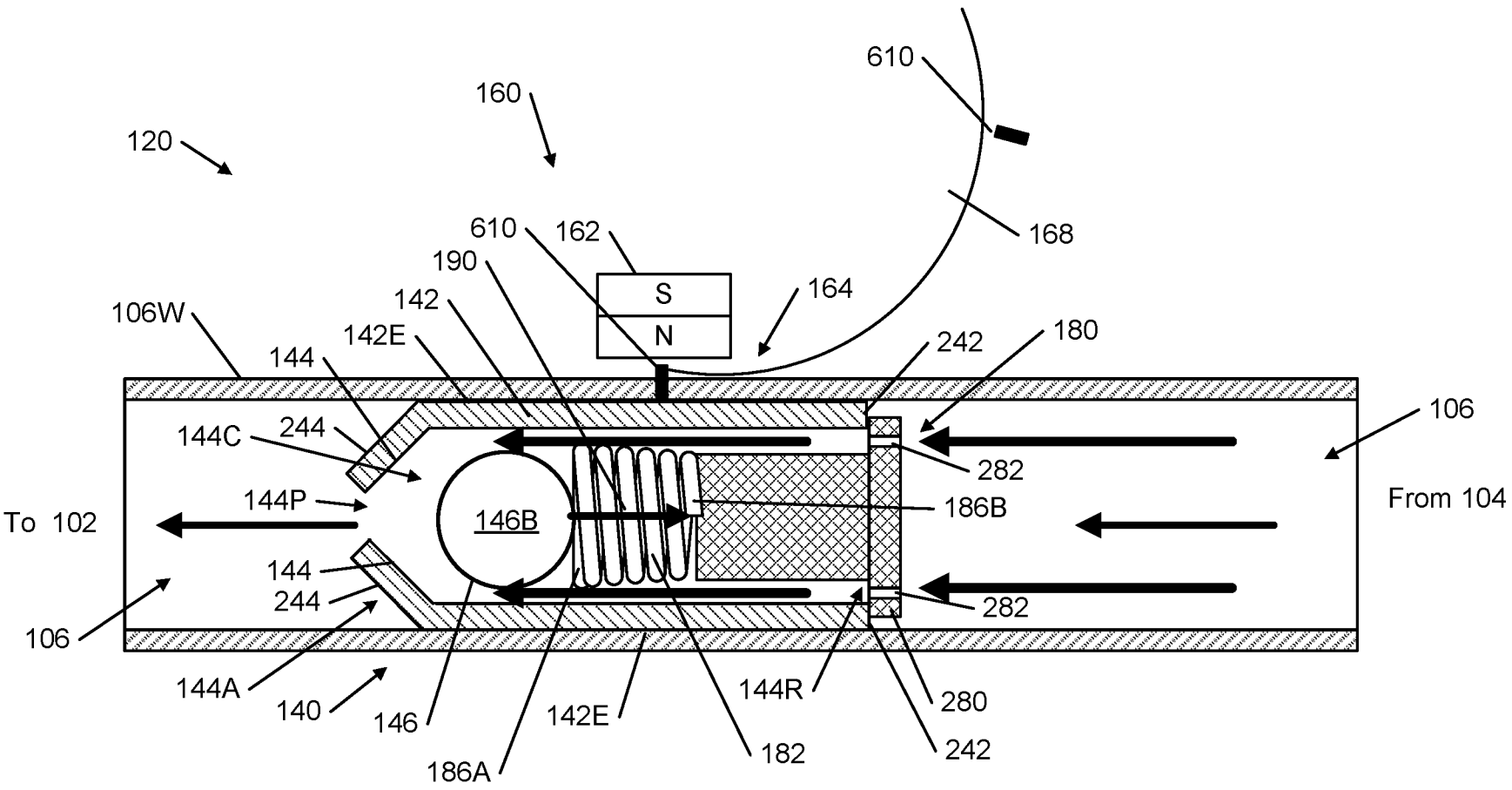
FIGS. 4A-4D illustrate fluid flow controllers and valve structures in accordance with other examples of this invention in various operational configurations.
Figure 4B:
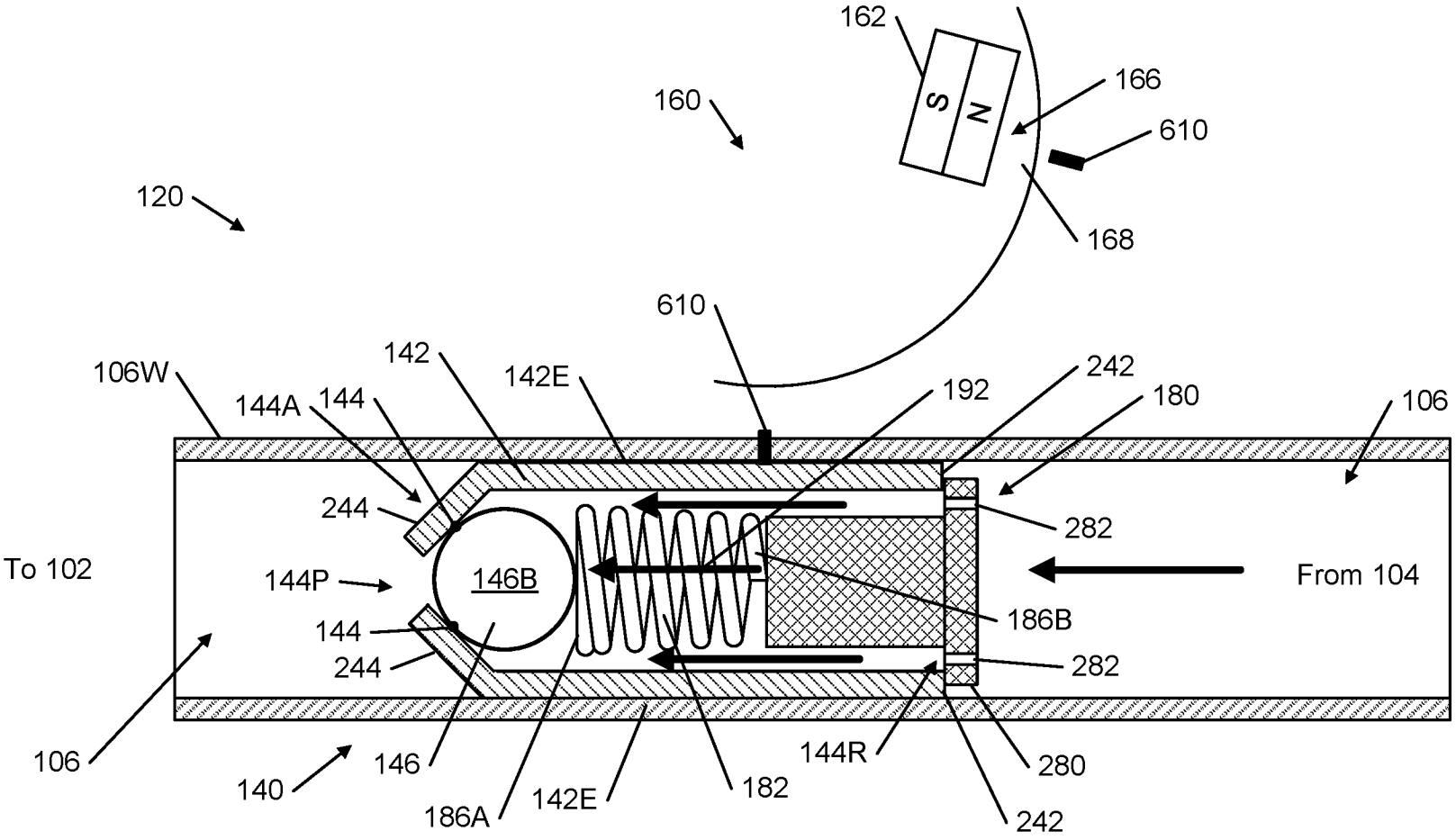
Figure 4C:
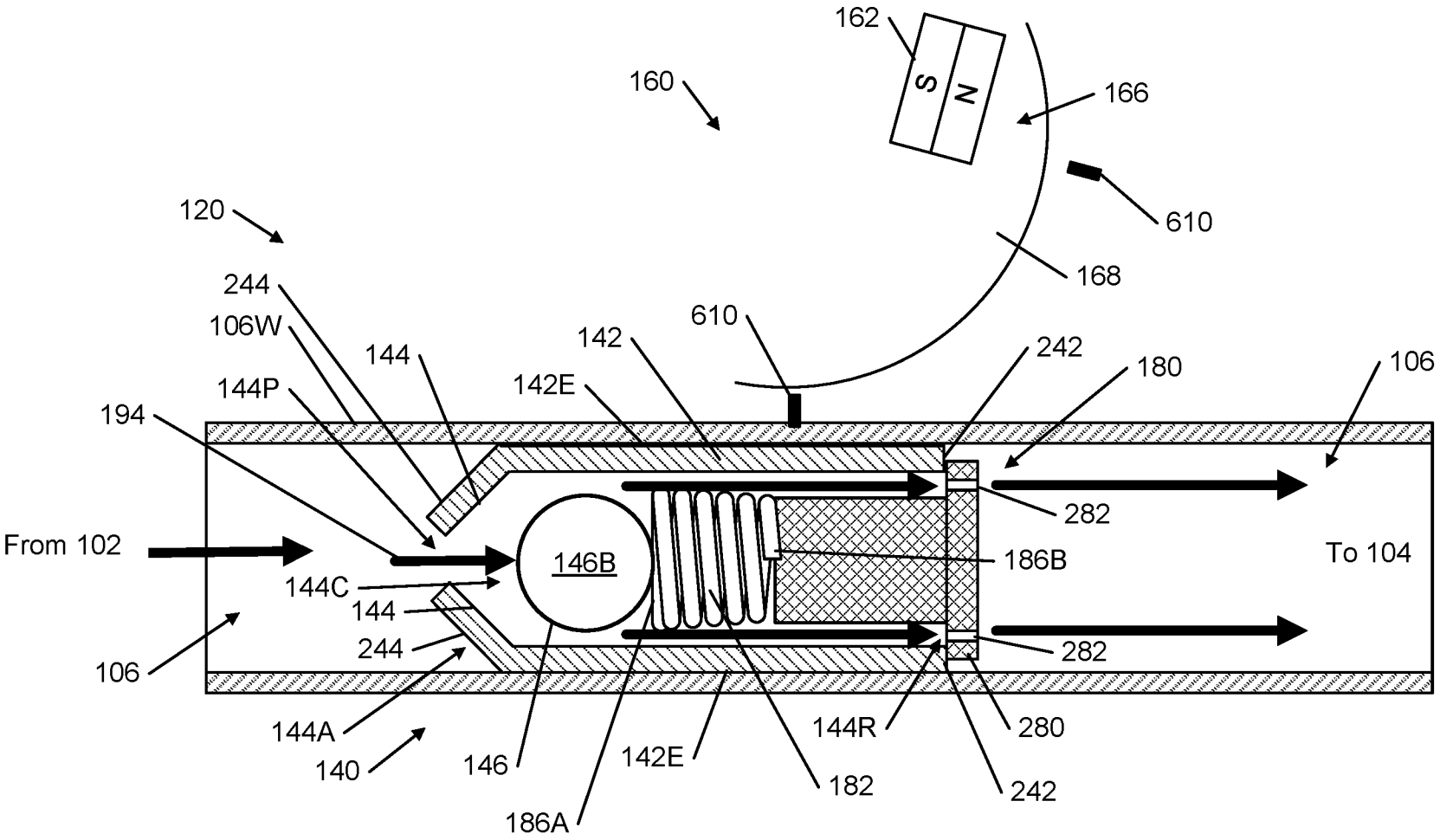

Another example fluid flow controller 120 with a valve 140 is shown in FIGS. 4A-4C. FIG. 4A shows the fluid flow controller 120/valve 140 in the open condition in which fluid flows through fluid transfer line 106 from the second fluid container 104 to the first fluid container 102 (e.g., to foot support fluid-filled bladder). FIG. 4B shows the fluid flow controller 120/valve 140 in the closed condition in which fluid flow through fluid transfer line 106 from the second fluid container 104 to the first fluid container 102 is stopped. FIG. 4C shows the fluid flow controller 120/valve 140 in the open condition in a "check valve" configuration in which fluid flow through fluid transfer line 106 from the first fluid container 102 to the second fluid container 104 occurs (e.g., when pressure in the first fluid container 102 exceeds pressure in the second fluid container 104 by a first predetermined pressure differential amount (e.g., 5 psi)). The structure and operation of this example fluid flow controller 120/valve 140 will be described in more detail below.

As shown in FIG. 4A, in this illustrated example, the valve 140 components are mounted within a tube wall 106W of fluid transfer line 106, which may be in the form of a plastic tube (e.g., a flexible plastic tube that defines an interior fluid flow channel). Alternatively or additionally, if desired, the fluid flow regulator 120/valve 140 could be formed as a separate part from fluid transfer line 106, and one or both ends of flow regulator 120/valve 140 may include a connector structure that connects to ends of a plastic tube or other structure forming the fluid transfer line 106. As an alternative, the fluid flow regulator 120 and/or valve 140 may be otherwise engaged with the fluid transfer line 106, such as by adhesive or cement, by mechanical connector(s), by fusing techniques, etc.

The valve 140 of this illustrated example includes a fixed valve part 142 having a valve component seating area 144. The fixed valve part 142 may be fixed to the interior surface of the tube wall 106W and within the tube interior channel (or fixed within a component part of the valve 140), e.g., by a cement or adhesive, a mechanical connector, etc. The side edge(s) 142E of fixed valve part 142 in contact with the interior surface of tube wall 106W may form a sealed structure that will not permit fluid to pass between the side edges 142E and the interior surface of the tube wall 106W. This example fixed valve part 142 includes a first end 144A forming a stop surface, and at least a portion of this first end/stop structure forms the valve component seating area 144 (e.g., the angled end surface 244 of fixed valve part 142 provides the valve component seating area 144 in this illustrated example). A second end 242 of the fixed valve part 142 located opposite from the first end 144A with the valve seating area 144 is open to allow fluid flow (e.g., and forms at least one fluid port 144R). A fluid channel 144C extends through the fixed valve part 142 from the first fluid port 144R to a second fluid port 144P located adjacent the valve seating area 144 and between the angled ends 244. As shown in FIGS. 4A-4C, the fixed valve part 142 of this example may have a generally tubular structure with an angled end surface 244 forming valve component seating area 144.

A movable valve part 146 also is provided within the tube wall 106W (or within a component part of the valve 140). In this illustrated example, this movable valve part 146 constitutes a ball (e.g., a metal ball 146B or ball bearing type structure) that is movable into and out of contact with the valve component seating area 144 of the fixed valve part 142. This movement can be seen, for example, by comparing FIGS. 4A and 4C with FIG. 4B (and is explained in more detail below). The outer surface of the movable valve part 146 ball 146B of this example is sized and shaped to tightly fit against the interior surface(s) of angled end surface 244 at valve seating area 144 to close off port 144P. If necessary or desired, the facing surfaces of the angled end 244 of the fixed valve part 142 and/or the ball 146B of movable valve part 146 may be formed of or treated by a material to enhance a sealing connection between the ball 146B and the interior walls of angled end surface(s) 244 (e.g., including one or more rubberized sealing surfaces, made from a soft/compressible material, etc.). At least some portion (and optionally all) of the movable valve part 146 (e.g., the ball 146B) may be made from a magnetically attractable material, such as a magnet, a magnetizable material, a ferromagnetic material, iron, etc., e.g., for reasons described in more detail below.

The fluid flow controller 120/valve 140 of this illustrated example further includes a biasing component 180 for holding the movable valve part 146 (e.g., ball 146B) in a "default" position so that the valve 140/fluid flow controller 120 will maintain one of an open condition (e.g., as shown in FIG. 4A) or a closed condition (e.g., as shown in FIG. 4B) when no other external forces act on movable valve part 146. In the embodiment of FIGS. 4A-4C, the biasing component 180 includes a spring 182 having one end 186A that engages the ball 146B of the movable valve part 146 and an opposite end 186B engaged with a base 280. The base 280 may include one or more openings 282 to allow fluid flow therethrough, and it may be fixed to the end 242 of the fixed valve part 142 located opposite from the angled end 244. Additionally or alternatively, if desired, the base 280 may be engaged with an interior surface of the tube wall 106A or with another structure, e.g., of the fluid flow controller 120 and/or valve 140. In this illustrated example, the spring 182 is located at least partially within (and in this example, completely within) the interior chamber formed by the tube wall 106W and an interior chamber or channel 144C formed by the fixed valve part 142. Any desired type of spring 182 and/or other biasing component(s) (e.g., coil spring; a leaf spring; a resilient component, such as a foam material; etc.) can be used without departing from this invention.

In the absence of external forces, the biasing component 180 of this illustrated example fluid flow controller 120/valve 140 is configured and arranged to push ball 146B of the movable valve part 146 tightly against the angled end surface(s) 244 of the fixed valve part 142, e.g., in the arrangement shown in FIG. 4B. The biasing force of the spring 182 is shown by force arrow 192 in FIG. 4B. In this manner, the ball 146B's outer surface is moved into contact with the stop surface and valve seating area 144 of the fixed valve part 142. As noted above, if necessary or desired, valve seating area 144 of the fixed valve part 142 and/or the ball 146B's outer surface may be made from a material and/or treated to enhance a sealing effect when these parts contact one another. This contacting or closed configuration closes the fluid path through the fluid flow controller 120/valve 140 and stops fluid flow at the ball 146B/valve seating area 144 location, as shown in FIG. 4B.

In this configuration of FIG. 4B, the magnet 162 is positioned at location 166 (the deactivation position) and away from the fluid flow controller 120/valve 140, as shown in FIG. 4B (and by broken lines in FIGS. 1A-1E). This may be accomplished, for example, by turning dial base 168 to rotate (or otherwise move) the magnet 162 a sufficient distance away from the ball 146B of the movable valve part 142 so that any magnetic attraction force between the magnet 162 and the ball 146B is overcome by the biasing force 192 of the spring 182 (or other biasing component). As an alternative, if magnet 162 is an electromagnet instead of a permanent magnet, in the closed configuration of FIG. 4B, the electromagnet may be in a powered off (or other lower power) condition. As yet another alternative, some type of intervening shield material may be positionable (e.g., movable by/with base 168) between magnet 162 and ball 146B of the movable valve part 146 to stop/attenuate magnetic attraction between these parts.

To change the pressure in the foot support bladder 102 (or other fluid container), starting with the fluid flow regulator 120/valve 140 in the closed configuration shown in FIG. 4B, first the control system 160 is controlled to move the magnet 162 into activation position 164 to apply a stronger magnetic attraction force to the ball 146B of the movable valve part 146. This may be accomplished, for example, by rotating a dial (e.g., or otherwise moving base 168), moving an intervening shield, entering input into an electronic input device 170 (e.g., such as a cellular telephone application program), powering on (or increasing power to) an electromagnet (manually or electronically), etc. When the magnet 162 is in the activation position 164, magnetic attraction between the magnet 162 and the ball 146B overcomes the biasing force 192 of biasing component 180 (e.g., spring 182) to pull the ball 146B away from the valve seating area 144 of the fixed valve part 142. This pulling force on the ball 146B is shown by force arrow 190 in FIG. 4A. The magnetic field/magnetic force 190 overcomes the spring 182 force 192 to hold the valve 140/flow controller 120 open. When gas pressure in the second fluid container 104 (e.g., a fluid reservoir bladder) is greater than the gas pressure in the first fluid container 102 (e.g., a foot support bladder), fluid will flow through the base 280 (e.g., through openings 282), through the fixed valve part 142, around/through spring 182, around movable ball 146B, to fluid port 144P of the fixed valve part 142, and to the first fluid container 102 (e.g., foot support bladder) via the first transfer line 106. If the fluid flow controller 120 and/or valve 140 is/are held in this open configuration for a sufficient time period, the gas pressure in the first fluid container 102 (e.g., a foot support bladder) will become equal to the gas pressure in the second fluid container 104 (e.g., a reservoir bladder). Thus, fluid flow controller 120 and/or valve 140 can be used in a foot support system 100 to equalize pressure between the foot support bladder 102 and the reservoir accumulator (e.g., bladder) 104 shown in FIG. 2 herein and in various embodiments of the inventions described in U.S. Provisional Patent Appln. No. 62/463,859 and U.S. Provisional Patent Appln. No. 62/463,892.

The movable valve part 146 (e.g., the ball 146B) of this example does not itself include a base-level of magnetic charge or a magnetic bias. Alternatively, if desired, the movable valve part 146/ball 146B could be magnetized to a desired level, e.g., to enable a manufacturer to change/control the external magnetic field (e.g., from magnet 162) required to open/close the valve 140 and/or to bias the valve 140 in one position or the other in combination with the force of the biasing system 180 (e.g., spring 182).

When fluid pressure is increased in the first container 102 (e.g., foot support bladder) to the desired level (e.g., as measured by a pressure sensor, as determined by a user, etc.), the magnet 162 can be returned to the deactivation position 166, as shown in FIG. 4B. This can be accomplished, for example, by moving the magnet 162 (e.g., rotating or otherwise moving dial and/or base 168), powering off an electromagnet, moving shielding between the magnet 162 and movable valve part 146, entering input into an electronic input device 170, etc. Once in the deactivation position 166 or deactivation condition, the biasing force 192 of the biasing component 180 (e.g., spring 182) will again overcome the magnetic attraction force 190 between magnet 162 and ball 146B of the movable valve part 146 to move and hold the ball 146B against the fixed valve part 142 and close/seal the valve 140/fluid flow controller 120 (e.g., seat the ball 146B's outer surface against valve seating surface 144 in the angled end surface(s) 244 and close port 144P).

FIG. 4C shows the fluid flow controller 120/valve 140 of this example structure in a check valve configuration. In this check valve configuration and operation, if gas pressure in the foot support bladder 102 ever increases above gas pressure in the second fluid container 104 (e.g., a reservoir or accumulator bladder) by at least a predetermined first pressure differential (e.g., 5 psi), the force applied by the gas through fluid transfer line 106 may become high enough to force the ball 146B of the movable valve part 146 in a direction to compress the spring 182 (e.g., depending on the spring constant k). This force on the ball 146B is shown by arrow 194. If the force 194 is sufficient, it will unseat ball 246B's surface from the valve seating surface 144 of the fixed valve part 142 at the angled end 244 and thereby open port 144P and channel 144C through the fixed valve part 142. In this situation, gas will move from the foot support bladder 102, through channel 144C in the fixed valve part 142, around the ball 146B, around and/or through spring 182, through the opening(s) 282 in the base 280, and into the second fluid container 104. Fluid can move through the fixed valve part 142 and around the movable valve part 146 and into the second fluid container 104 until the force 194 from gas in the foot support bladder 102 is insufficient to overcome the spring 182 biasing force 192. At that time, the fluid flow controller 120/valve 140 will return to the configuration of FIG. 4B. By selecting an appropriate spring constant k for spring 182, the pressure differential between first fluid container 102 and second fluid container 104 sufficient to "crack" the valve 140 into this check valve configuration can be controlled.

Figure 4D:
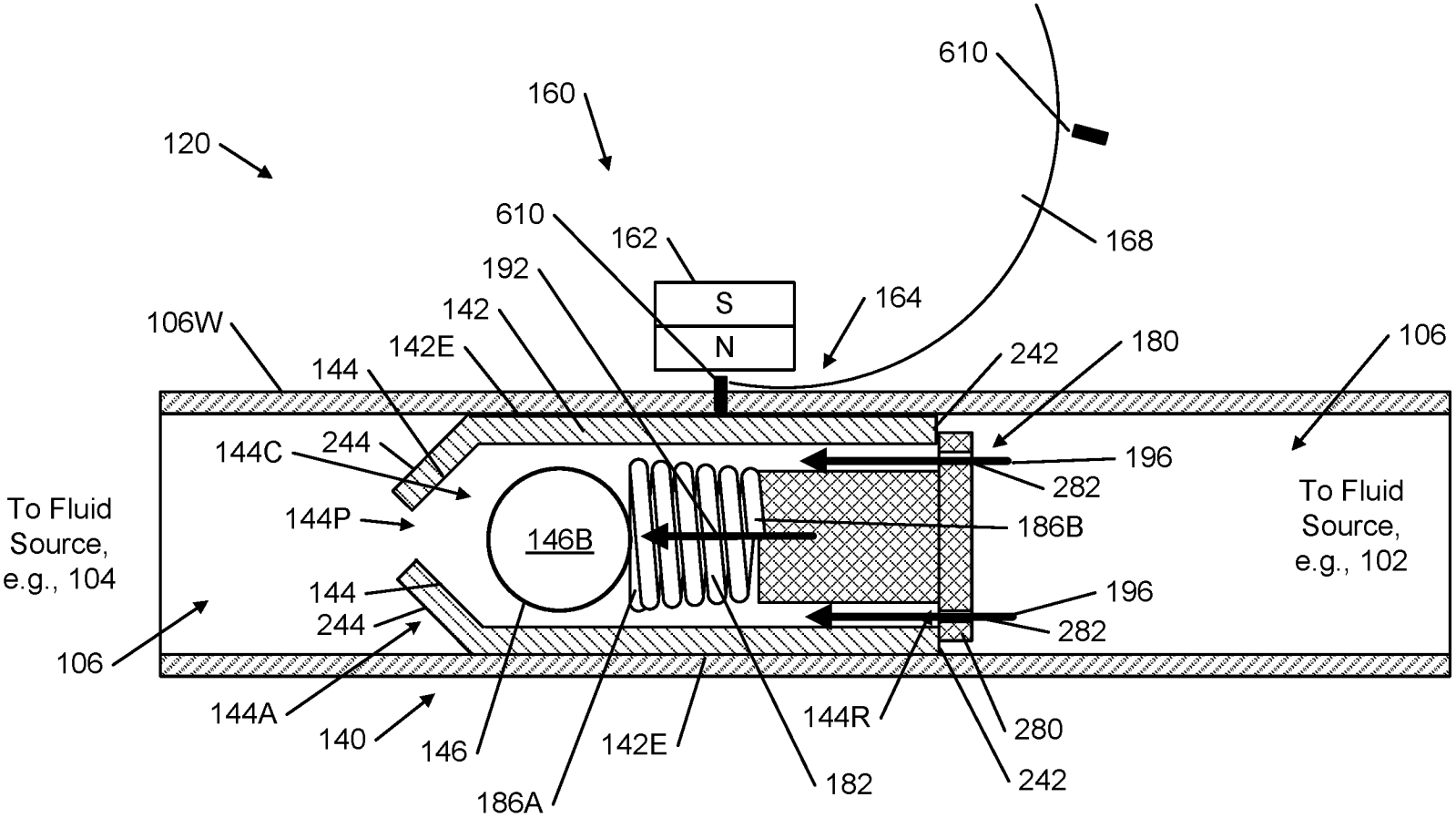

FIG. 4D shows a fluid flow controller 120 having the same structure as shown in FIGS. 4A-4C, but in this example, the fluid flow controller 120 is included in a fluid transfer line 106 shown more generally engaged with "fluid sources." In some examples of the invention, this fluid flow controller 120 will be connected to/in fluid communication with: (a) container 104 (e.g., a reservoir container or bladder engaged with a footwear sole structure and/or upper for an article of footwear) at a first end of fluid transfer line 106 (e.g., the left side of FIG. 4D, at the first end of valve 140) and (b) container 102 (e.g., a foot support bladder in a footwear sole structure) at the opposite end of the fluid transfer line 106 (e.g., the right side of FIG. 4D, at the second (opposite) end of valve 140). This arrangement may be advantageous, in at least some examples of this invention, so that impact force between a wearer's foot and the foot support bladder 102 will cause a pressure increase (or pressure impulse force or spike due to the ground contact) that helps more forcefully seat the movable valve part 146 (ball 146B) against the valve seating area 144. This may occur, for example, if the added force 196 or impulse force from the fluid pressure pushes against the ball 146B surface of the movable valve part 146. The fluid pressure force 196 acts in addition to the force 192 from the biasing system 180, as described above, to even more securely seat the movable valve part 146 with the valve seating area 144. This enhanced valve 140 seating feature as a result of foot strike impulse pressure on the foot support bladder 102 can help assure that the valve 140 remains sealed and closed to prevent pressure loss from the foot support bladder 102 throughout the foot strike event. The fluid flow controller 120 of FIG. 4D can operate as a combined equalizer valve and check valve, opening and closing in the general manners described above in conjunction with FIGS. 4A-4C.

The invention may take on various different structures and/or arrangements of parts. In some example structures, the flow regulator 120 will consist essentially of or consist of the valve 140. Additionally or alternatively, in some systems, the control system 160 (e.g., as described above) may be considered part of the flow regulator 120. As still further options or alternatives, the biasing system and/or biasing component 180 may be considered part of the flow regulator 120 and/or the valve 140. Such variations are considered to be within the scope and aspects of this invention.

Figure 5A:
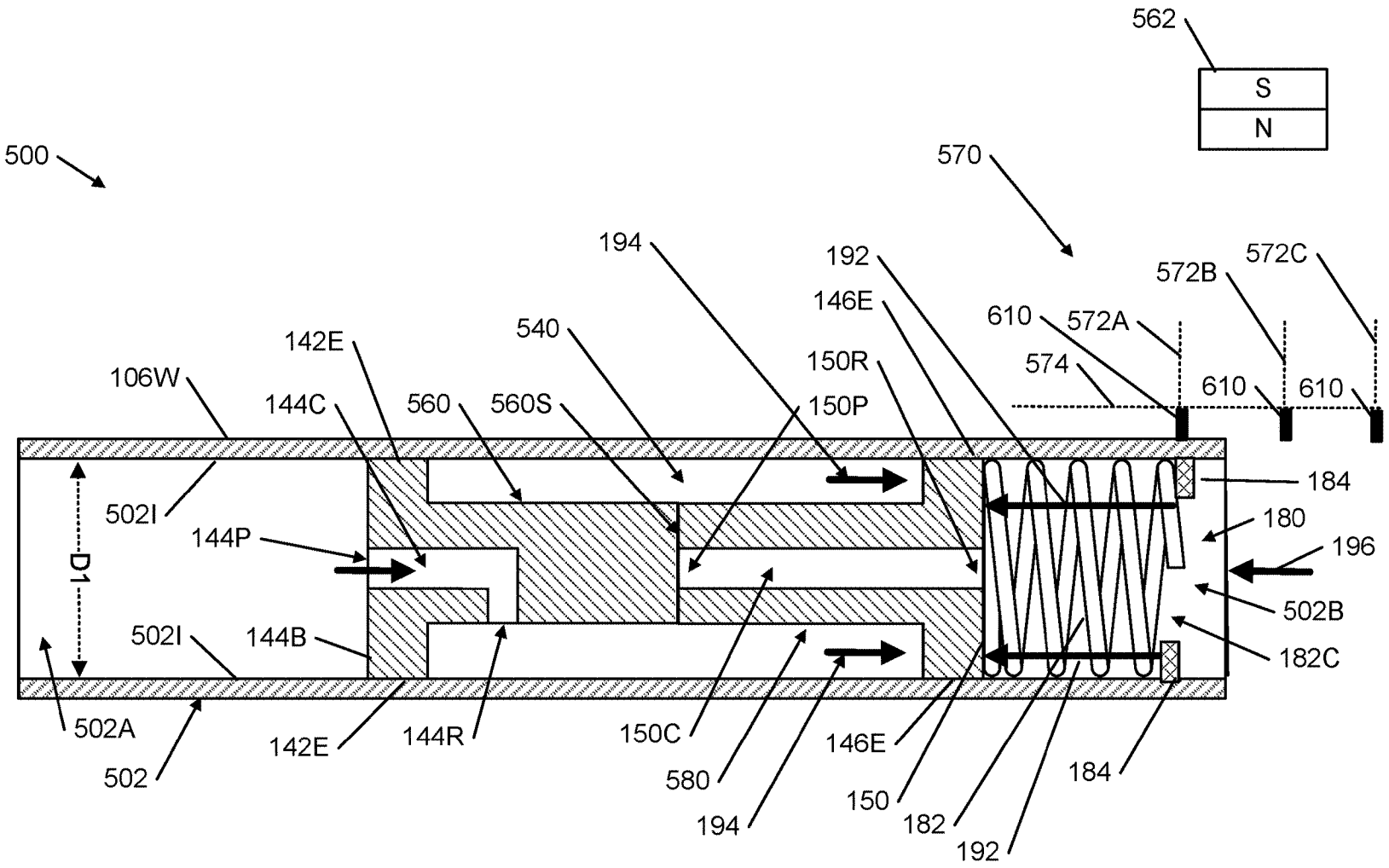
FIGS. 5A-7B illustrate fluid flow controllers, valve structures, and/or variable and/or adjustable valve structures in accordance with some examples and aspects of this invention in various operational configurations.
Figure 5B:
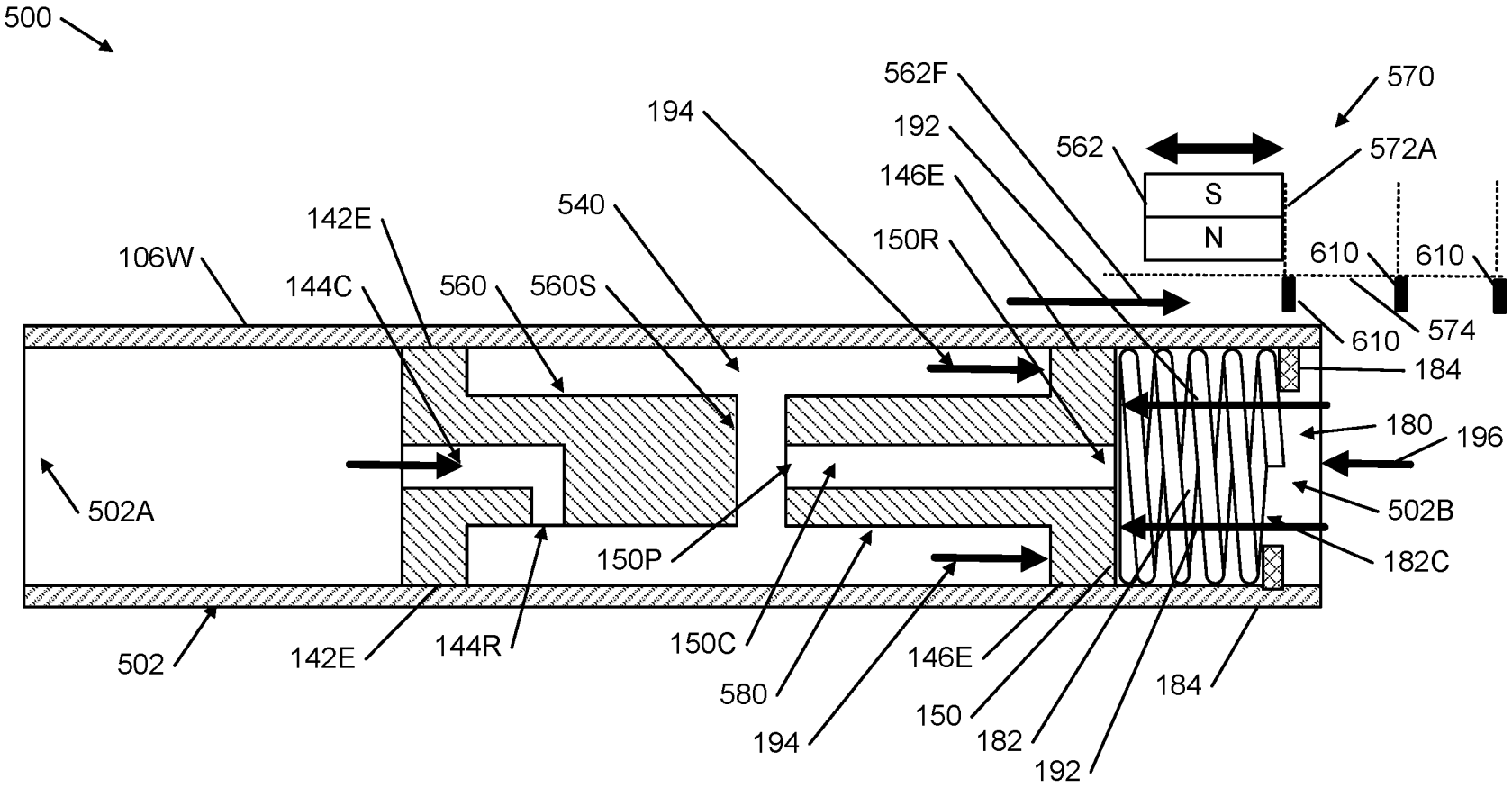
Figure 5C:
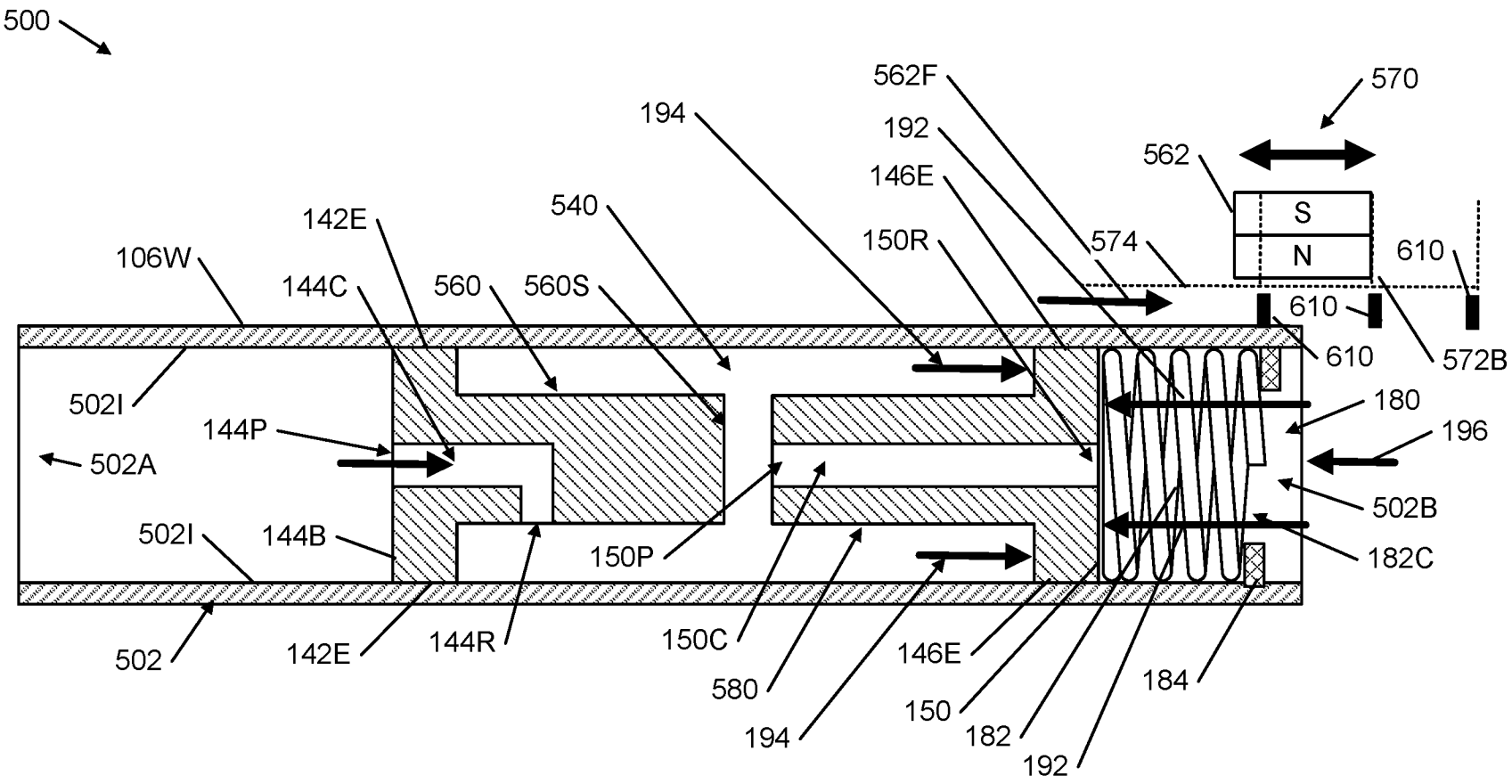
Figure 5D:
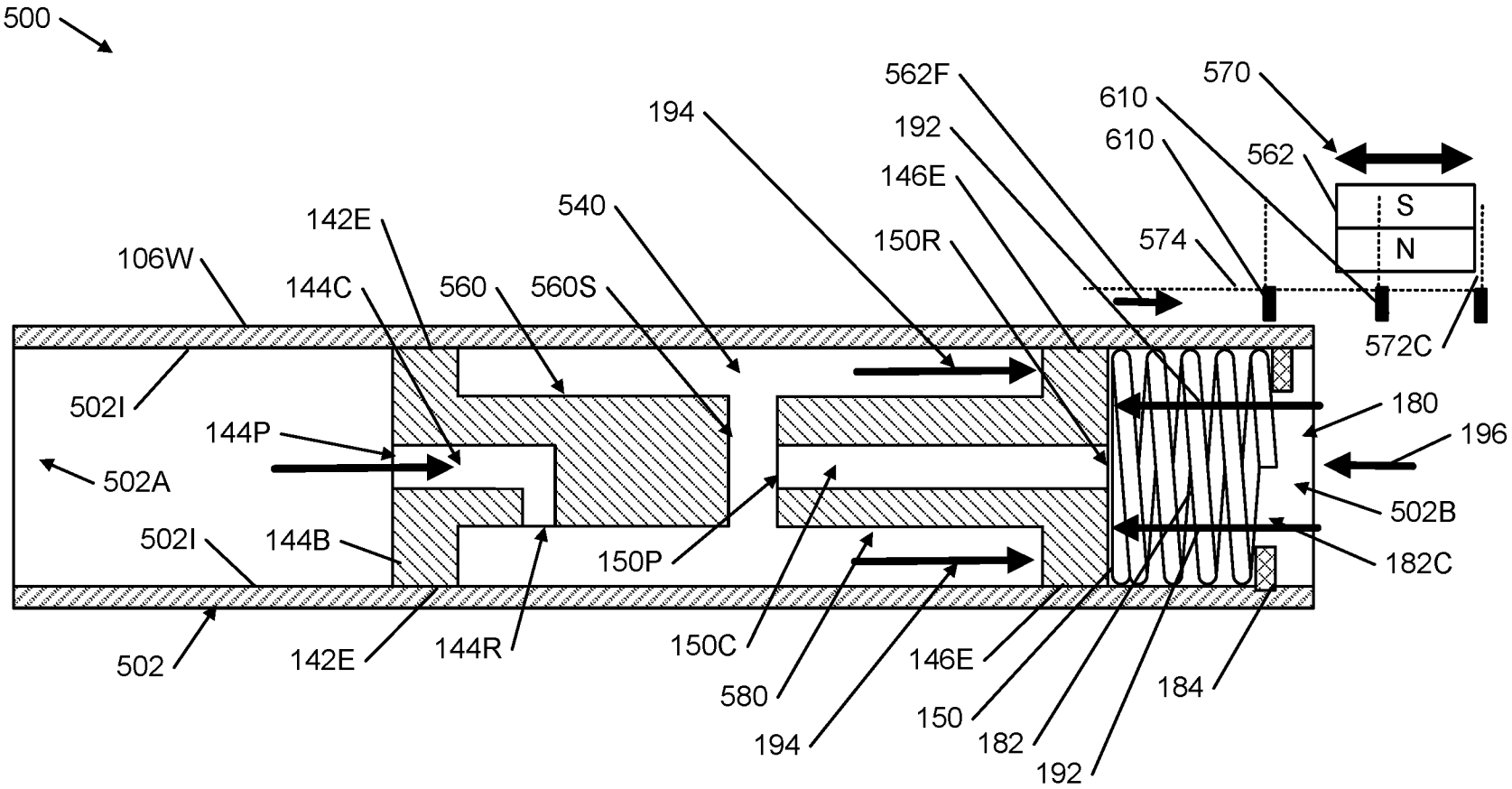
Figure 5E:
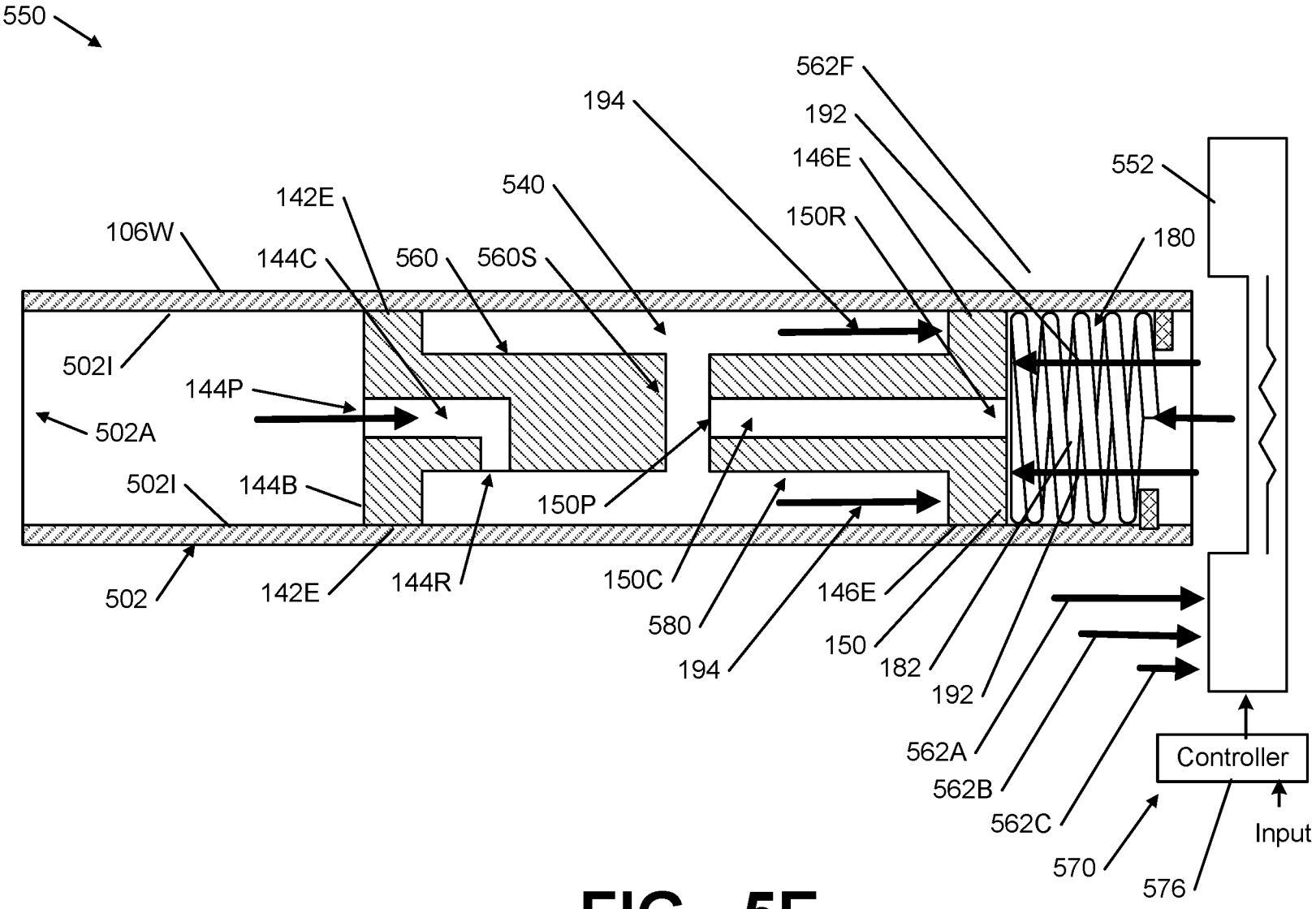
Figure 6:
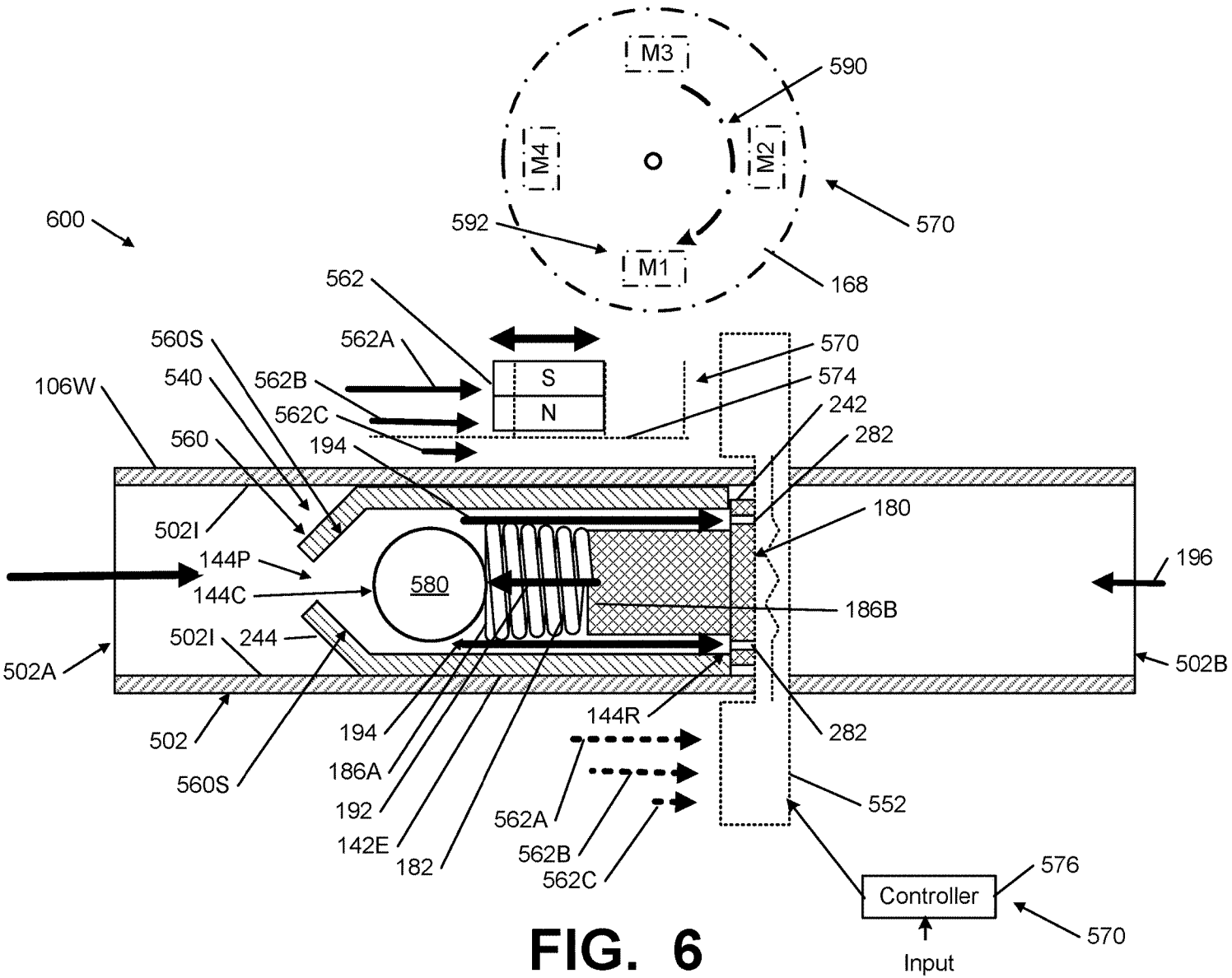

FIGS. 5A-6 illustrate various examples of fluid flow control systems and methods (or fluid flow regulators) that correspond to and/or may be used in at least some examples or aspects of this invention. These systems and methods may include features to enable selective control, adjustment, and/or modification of the crack pressure of a valve (e.g., a check valve) using magnetic field strength.

The fluid flow control system 500 and methods of FIGS. 5A-5D include a fluid line 502 having a first end 502A and a second end 502B opposite the first end 502A. The fluid line 502 defines an interior surface 502I extending between the first end 502A and the second end 502B, and this interior surface 502I defines an interior chamber through which fluid may flow (e.g., under conditions described in more detail below). An adjustable valve 540 (e.g., having an adjustable crack pressure) is provided within this fluid line 502. The adjustable valve 540 includes a fixed valve part 560 sealingly engaged with the interior surface 502I of the fluid line 502 and a valve component seating area 560S. This adjustable valve 540 further includes a movable valve part 580 that is movable into and out of contact with the valve component seating area 560S, and this movable valve part 580 includes at least a portion made from a magnetic attractable material. In this illustrated example, the entire movable valve part 580 is made from a magnetic attractable material, but less than the entire movable valve part 580 may be made from such a material if desired. A "magnetically attractable material" as used herein, includes a magnet, a magnetizable material, or a material that is attracted to a magnet by magnetic forces (such as a ferromagnetic material, such as iron). The adjustable valve 540 of this example may have any of the structures, features, and/or options as described above in conjunction with the structures of FIGS. 3A-3D, and it may operate in the same manners as described above in conjunction with FIGS. 3A-3D. When the same reference numbers from FIGS. 3A-3D are used in FIGS. 5A-5D, these reference numbers are intended to refer to the same or similar parts, and much of the repetitive description thereof is omitted.

As part of this fluid flow control system 500, a magnet 562 is located outside the interior chamber of the fluid line 502. The system 500 further includes a "means (570) for controlling a strength of a magnetic field incident on the movable valve part 580," examples and example structures of which are described in more detail below. In the arrangement of FIG. 5A, the magnet 562 is located at a remote position sufficiently far removed from the movable valve part 580 so that its magnetic field does not apply a significant magnetic force on the movable valve part 580. In the arrangement of FIG. 5A (with the magnet 562 far removed), the forces 192 from the biasing system 180 (and potentially any fluid forces 196 present through second end 502B) overcomes the fluid forces 194 from the first end 502A on the movable valve part 580 so that the movable valve part 580 seats (and seals) on the valve seating area 560S of the fixed valve part 560.

Therefore, in this example system 500, in the arrangement shown in FIG. 5A: (a) forces on the movable valve part 580 from the first end 502A direction include fluid pressure forces 194 from the fluid source (if any) in fluid communication with the first end 502A (e.g., a fluid-filled bladder 102 or container, e.g., in a footwear structure as described above), and (b) forces on the movable valve part 580 from the second end 502B direction include fluid pressure forces 196 from the fluid source (if any) in fluid communication with the second end 502B (e.g., a fluid-filled bladder or container 104), e.g., in a footwear structure as described above) and force 192 from the biasing system 180 (e.g., spring 182). If the combined forces from the second end 502B direction ($F_{192}+F_{196}$) are greater than the forces from the first end 502A direction ($F_{194}$), the valve 540 will remain closed, e.g., in the configuration shown in FIG. 5A.

The magnet 562 and the means 570 for controlling the strength of the magnetic field incident on the movable valve part 580, however, can be used to modify, adjust, and/or control the fluid pressure from the first end 502A at which the adjustable valve 540 will "crack" (e.g., open to the configuration shown in FIGS. 5B to 5D) to allow fluid flow from the first end 502A direction to the second end 502B direction. In this manner, the crack pressure of valve 540 can be controlled and/or maintained within a desired range.

FIG. 5B shows the system 500 of FIG. 5A except now the magnet 562 is provided at a first location 572A where its magnetic forces (shown by force arrow 562F) are incident on (and apply force to move) the movable valve part 580. Thus, in this arrangement, the movable valve part 580 can move to the open position to allow fluid to flow through port 150P, through channel 150C, and from the first end 502A to the second end 502B of the fluid line 502. The adjustable valve 540 will convert to this open configuration shown in FIG. 5B when:

(a) the combined forces on the movable valve part 580 from (i) fluid pressure forces 194 from the first end 502A direction and (ii) magnetic forces 562F from the magnet 562 overcome (and are greater than)

(b) the combined forces on the movable valve part 580 from (i) fluid pressure forces 196 from the second end 502B direction and (ii) forces 192 from the biasing system 180 (e.g., spring 182).

In other words, the adjustable valve 540 will "crack" open (e.g., to the configuration shown in FIG. 5B) if the forces of part (a) above overcome the forces of part (b) (valve 540 opens if $F_{194}+F_{562F}>F_{192}+F_{196}$, where $F_{194}$ is the fluid pressure force 194 on the movable valve part 580 from the first end 502A, $F_{562F}$ is the magnetic field force 562F on the movable valve part 580, $F_{192}$ is the biasing system 180 force 192 on the movable valve part 580, and $F_{196}$ is the fluid pressure force 196 on the movable valve part 580 from the second end 502B). If the forces of part (a) above (i.e., the magnetic field force 562F plus the fluid force 194 from first end 502A direction) are not sufficient to overcome the forces of part (b) above (i.e., the biasing force 192 plus the fluid force 196 from the second send 502B direction), the adjustable valve 540 will remain closed (e.g., in the configuration shown in FIG. 5A). In other words, adjustable valve 540 closes or remains closed if $F_{194}+F_{562F}<F_{192}+F_{196}$.

In the example configuration shown in FIG. 5B, the magnet 562 is oriented at a first location 572A with respect to the movable valve part 580. Magnetic forces and magnetic field strength change, however, for example, depending on the distance of the magnet (e.g., 562) from the component on which the magnet is acting (e.g., movable valve part 580). FIG. 5C shows the same fluid flow system 500 of FIGS. 5A and 5B, but in the example of FIG. 5C, the magnet 562 is located a further distance from the movable valve part 580 (at second location 572B). This increased distance decreases the force 562F applied to the movable valve part 580 by the magnet 562 (as shown by the shorter force arrow 562F in FIG. 5C as compared to FIG. 5B). Thus, the combined forces on the movable valve part 580 from (i) fluid pressure forces 194 from the first end 502A direction and (ii) magnetic forces 562F from the magnet 562 are less in the arrangement of FIG. 5C as compared to the arrangement in FIG. 5B. If the combined forces on the movable valve part 580 from (i) fluid pressure forces 196 from the second end 502B direction and (ii) forces 192 from the biasing system 180 (e.g., spring 182) remain the same in FIG. 5B and FIG. 5C, then, because of the decreased magnetic force $F_{562F}$ in the FIG. 5C arrangement as compared to the FIG. 5B arrangement, a greater fluid pressure force $F_{194}$ from the first end 502A direction will be needed to switch the adjustable valve 540 from the closed condition (of FIG. 5A) to the open condition of FIG. 5C as compared to the fluid pressure force $F_{194}$ from the first end 502A direction needed to switch the adjustable valve 540 from the closed condition (of FIG. 5A) to the open condition of FIG. 5B. By adjusting the position of the magnet 562 with respect to the movable valve part 580 (which includes a magnetic attractable material), the fluid pressure necessary from the first end 502A ($F_{194}$) direction to "crack" the valve 540 to the open configuration can be modified, adjusted, and/or controlled.

FIG. 5D shows the same fluid flow system 500 of FIGS. 5A-5C, but in the example of FIG. 5D, the magnet 562 is located a still further distance from the movable valve part 580 (at third location 572C). This further increased distance further decreases the force 562F applied to the movable valve part 580 by the magnet 562 (as shown by the shorter force arrow 562F in FIG. 5D as compared to FIG. 5C). Therefore, the combined forces on the movable valve part 580 from (i) fluid pressure forces 194 from the first end 502A direction and (ii) magnetic forces 562F from the magnet 562 are less in the arrangement of FIG. 5D as compared to the arrangement in FIG. 5C. If the combined forces on the movable valve part 580 from (i) fluid pressure forces 196 from the second end 502B direction and (ii) forces 192 from the biasing system 180 (e.g., spring 182) remain the same in FIG. 5C and FIG. 5D, then, because of the decreased magnetic force $F_{562F}$ in the FIG. 5D arrangement as compared to the FIG. 5C arrangement, a greater fluid pressure force $F_{194}$ from the first end 502A direction will be needed to switch the adjustable valve 540 from the closed condition (of FIG. 5A) to the open condition of FIG.

5D as compared to the fluid pressure force $F_{194}$ from the first end 502A direction needed to switch the adjustable valve 540 from the closed condition (of FIG. 5A) to the open condition of FIG. 5C or FIG. 5B. This further example further illustrates the manner in which the position of the magnet 562 with respect to the movable valve part 580 (which includes a magnetic attractable material) can be used to modify, change, and/or control the fluid pressure necessary from the first end 502A ($F_{194}$) to "crack" the valve 540 to the open configuration.

The "means" 570 for controlling the strength of the magnetic field incident on the movable valve part 580 may be of any desired structure and/or construction. In some examples, this means 570 will constitute any structure or system that can allow a magnet 562 to be physically moved and/or held in two or more different positions with respect to the location of the movable valve part 580 (e.g., any structure or system for moving the magnet 562 toward and/or away from the movable valve part 580). In this manner, the means 570 for controlling the strength of the magnetic field changes the strength of the magnetic field incident on the movable valve part 580 between at least a first magnetic field strength and a second magnetic field strength that is less than the first magnetic field strength, and optionally, changing the magnetic field strength between three different strengths (as shown by the examples of FIGS. 5B-5D), or even more different magnetic field strengths (as shown by the examples of FIGS. 5A-5D).

In the example of FIGS. 5A-5D, the means 570 for controlling the strength of the magnetic field includes a track 574 (e.g., a curved or linear track), wherein the magnet 562 is movable via track 574 to change a physical distance between the magnet 562 and the movable valve part 580 (e.g., movable between three discrete positions 572A, 572B, and 572C in the example of FIGS. 5B-5D). The track 574 may be provided on an upper or sole structure for an article of footwear (on any desired footwear component). If desired, the magnet 562 may be releasably fixed to the discrete positions 572A, 572B, and 572C and/or any desired position along the track 574, e.g., using a set screw, a hook-and-loop fastener, other mechanical fasteners, spring-loaded fastener components, or the like. The magnet 562 may be mounted on a movable carriage that could be a manually moved along the track 574 (and manually fixed with respect to the track) or moved under an electronically controlled device (movable under commands sent by an electronic input system 170, such as a cellular telephone app or other electronic device). As another option or alternative, the magnet 562 may be releasably fixed to the track 574 or footwear component at least in part using magnetic attractive forces.

As additional or other alternatives, as described above in conjunction with component 168, the magnet 562 of the example of FIGS. 5A-5D may be mounted on a movable (e.g., rotatable) base 168, such as a rotatable dial or disk, that moves (e.g., rotates) between (and optionally may be fixed at) two or more positions to thereby vary and change the physical distance from (and thereby the magnetic field strength and the magnetic force experienced by) the movable valve part 580. The movable base 168 could be a manually operated switch (e.g., a rotary dial type switch, etc.) or an electronically controlled device (movable under commands sent by an electronic input system 170, such as a cellular telephone app or other electronic device). In this manner, the means 570 for controlling the strength of the magnetic field includes the dial and/or any related structures that support movement and fixing of the dial in one or more locations. As yet another alternative, the means 570 for controlling the strength of the magnetic field may include one or more pockets and/or mount structures located near the movable valve part 580 that allow a user to selectively mount or remove a magnet 562 from the pocket or mount structure. In some examples of this alternative of the invention, the magnet 562 may be mounted on a base having two or more different pockets or mount structures located different distances from the movable valve part 580 (to thereby allow the magnetic field strength/magnetic force experienced by the movable valve part 580 to be varied).

As yet another additional or alternative feature, the means 570 for controlling the strength of the magnetic field may include a set of magnets (e.g., two or more magnets, optionally 2-4 magnets) that can be selectively placed at one or more locations to interact magnetically with the movable valve part 580. The set of magnets may include two or more magnets located outside the interior chamber of the fluid line 502. In such a system, a user may select a desired magnet from the set and/or a device that selectively places and/or holds one of the magnets from the set at a first location with respect to the movable valve part 580 may be provided. For multiple magnets of different magnetic field strengths mounted on a rotary dial or track, the means 570 for controlling the strength of the magnetic field could selectively hold one of the magnets at the first location with respect to the movable valve part 580, e.g., using the track, dial, or any of the fixing/mounting structures described above. One of the magnets of the set also may be selectively placed or mounted in a pocket or other mount structure, e.g., provided on a footwear component.

The above examples of FIGS. 5A-5D illustrate use of a permanent magnet 562 in systems 500 and methods in accordance with some examples of this invention. FIG. 5E shows a similar fluid flow control system 550 in which an electro-magnet 552 is used to apply the magnetic force to the movable valve part 580. The electromagnet 552 may include one or more coils that wrap around the fluid tube 502. In this example, the means 570 for controlling the strength of the magnetic field incident on the movable valve part 580 includes a controller 576 that changes the electric current supplied to the electromagnet 562. The change in magnet force applied to the movable valve part 580 as a result in the change of current to the electromagnet 562 is shown in FIG. 5E by the varying sized force arrows 562A (greatest current and greatest magnetic field/force), 562B (medium current and medium magnetic field/force), and 562C (smallest current and smallest magnetic field/force). By varying the electric current to the electromagnet 552 (and thus the magnetic field strength and magnetic force incident on the movable valve part 580), the crack pressure of the adjustable valve 540 can be varied and controlled, e.g., in the manners described above in conjunction with FIGS. 5A-5D. User input (e.g., entered manually or electronically, e.g., through an application program) can be used to selectively change the current settings.

FIG. 6 illustrates another example fluid flow system 600 including an adjustable valve 540 and/or the variable crack pressure features of aspects of the invention described above in conjunction with FIGS. 5A to 5E applied to a ball valve configuration, e.g., of the types described above relating to FIGS. 4A to 4D. When the same reference numbers are used in FIG. 6 as are used in FIGS. 4A to 5E, the same or similar parts are being referred to, and much of the repetitive description is omitted. The adjustable valve 540 of this example may have any of the structures, features, and/or options as described above in conjunction with the structures of FIGS. 4A-4D, and it may operate in the same general manners as described above in conjunction with FIGS. 4A-5E.

The fluid flow control system 600 and method of FIG. 6 include a fluid line 502 having a first end 502A and a second end 502B opposite the first end 502A. The fluid line 502 defines an interior surface 5021 extending between the first end 502A and the second end 502B, and this interior surface 5021 defines an interior chamber through which fluid may flow (e.g., under conditions described above). An adjustable valve 540 (e.g., having an adjustable crack pressure) is provided within this fluid line 502. The adjustable valve 540 includes a fixed valve part 560 sealingly engaged with the interior surface 5021 of the fluid line 502 and a valve component seating area 560S. This adjustable valve 540 further includes a movable valve part 580 (a ball in this example) that is movable into and out of contact with the valve component seating area 560S. The movable valve part 580 of this example also includes at least a portion made from a magnetic attractable material. In this illustrated example, the entire movable valve part 580 ball is made from a magnetic attractable material, but less than the entire movable valve part 580 ball may be made from such a material, if desired.

FIG. 6 further illustrates various potential "means" 570 for controlling the strength of the magnetic field incident on the movable valve part 580 that may be used individually or in any desired combination. For example, FIG. 6 illustrates a track 574 along which magnet 562 can be moved to and/or mounted at two or more locations to vary the distance between the magnet 562 and the movable valve part 580 (and thus vary the magnetic forces 562A, 562B, 562C applied to the movable valve part 580). The track 574 can operate and/or have any of the features described above for the similar parts in FIGS. 5A-5D. As an additional or alternative "means" 570 for controlling the strength of the magnetic field incident on the movable valve part 580, FIG. 6 shows the electromagnet 552 features of FIG. 5E, including a controller 576 for varying the electric current supplied to the electromagnet 552 to vary the magnetic forces 562A, 562B, 562C applied to the movable valve part 580. The electromagnet 552 and/or controller 576 can operate and/or have any of the features described above for the similar parts in FIG. 5E. FIG. 6 further shows a rotary dial 168 on which one or more magnets are provided (M1 to M4 are shown in FIG. 6). When one magnet M1 is present on the dial 168, by turning the rotary dial 168 (as shown by arrow 590 in FIG. 6), manually or under electronic/automatic control, the distance between the magnet M1 and the movable valve part 580 can be varied and controlled to allow variations in the magnetic field/magnetic force experienced by the movable valve part 580. When multiple magnets (e.g., M1 to M4) are present on the rotary dial 168 having different magnetic field strengths, the magnetic field/magnetic force incident on the movable valve part 580 can be changed by changing the specific magnet M1 to M4 positioned at location 592 to interact with the movable valve part 580. If desired, as another potential option or alternative, a magnet or a set of magnets can be provided and selectively mounted (e.g., at location 592) in a pocket or another mount structure. Changing the magnetic field strength and/or magnetic force on the movable valve part 580 can allow one to control and/or change the crack pressure of the valve 540, e.g., in the manners described above in conjunction with FIGS. 5A to 5E.

As still additional examples, the "means" 570 for controlling the strength of a magnetic field incident on a movable valve part may constitute a movable shield that can be moved between the magnet and the movable valve part to alter or attenuate the magnetic force applied to the movable valve part. Additionally or alternatively, in at least some examples of this aspect of the invention, an amount of the shielding material (e.g., a thickness of the shielding material (e.g., provided as a wedge), the number of shields (e.g., in a stacked arrangement) or the type of shielding material may be varied to enable application of greater or lesser magnetic fields to the movable valve part. The movable shield(s) may be movable in any desired manner, including in any of the manners described above for physically moving the magnet (e.g., a track, a dial, placement in pockets, etc.).

Systems and methods according to some examples of this invention as described above allow the crack pressure of a valve 140, 540 to be controlled, modified, and/or varied, at least in part, by changing the magnetic field to which the movable valve part 146, 580 is exposed. This may be accomplished, for example, as described above, by changing the magnetic force applied to the movable valve part 146, 580 by changing one or more of: a magnet, a magnetic field strength, a magnet physical location with respect to the movable valve part, a current supplied to an electromagnet in the overall system or method, or an amount of shielding material provided between the magnet(s) and the movable valve part 146, etc. Additionally or alternatively, if desired, the movable valve part 146, 580 may itself include some non-zero base level of magnetic charge or non-zero magnetic bias (e.g., it may be magnetized). This non-zero base level of magnetic charge or non-zero magnetic bias of the movable valve part 146, 580 may provide a magnetic force that combines with the magnetic force from the magnet 162, 562, 552 to move the movable valve part 146, 580 between the closed and open configurations, e.g., in the various manners described above.

The fluid line 502 may have any desired sizes, shapes, and/or characteristics and may be engaged at its ends 502A/502B with any desired fluid source(s), including the ambient environment on at least one end. In at least some examples of this invention, however, the fluid line 502 may constitute flexible plastic tubing in which the adjustable valve 540 part(s) may be mounted (e.g., fixed by adhesives or cements, crimped in place, etc.). In some more specific examples of this invention, the fluid line 502 may constitute plastic tubing (e.g., flexible tubing) having an interior diameter D1 (see FIG. 5A) (or a largest interior dimension in one direction, if not round) of less than 50 mm, and in some examples, less than 35 mm, less than 25 mm, less than 18 mm, less than 15 mm, less than 12.5 mm, less than 10 mm, less than 8 mm, or even less than 6 mm. The fluid line 502 may be connected and/or in fluid communication at its opposite ends 502A/502B with any desired fluid source, including a fluid container, a fluid-filled bladder (e.g., for footwear and/or foot support), a fluid reservoir, or the like. As yet other examples, the fluid line 106, 502 may be thermoformed by heat and pressure or by welding techniques (e.g., RF welding, UV welding, laser welding, etc.) to join two regions or sheets of plastic material (e.g., thermoplastics), e.g., of the types used to form fluid-filled bladders for footwear sole structures.

As some more specific examples, e.g., as described above in conjunction with FIGS. 1A through 4D, the fluid flow control systems of FIGS. 5A to 6 may be incorporated into a sole structure, an upper, and/or an article of footwear (any desired footwear component). Such footwear examples may include: (a) a first fluid-filled container or bladder support 102 (e.g., included in the footwear sole structure); (b) a second fluid-filled container or bladder support 104 (e.g. including in the footwear sole structure and/or the footwear upper); and a fluid flow control system 500, 550, 600, e.g., of the types described above and shown in FIGS. 5A to 6. The first end 502A of the fluid line 502 may be in fluid communication with the first fluid-filled container or bladder support 102, and the second end 502B of the fluid line 502 may be in fluid communication with the second fluid-filled container or bladder support 104 (or vice versa, where the first end 502A of the fluid line 502 is in fluid communication with the second fluid-filled container or bladder support 104, and the second end 502B of the fluid line 502 is in fluid communication with the first fluid-filled container or bladder support 104). The fluid flow control systems 500, 550, 600 of FIGS. 5A to 6 may be provided as part of or engaged with any of the sole structure, the upper, and/or other component part of an article of footwear, e.g., in any of the manners described above in conjunction with FIGS. 1A to 1E.

When incorporated into a footwear structure in which one end of the flow regulator 120, valve 140, and/or fluid flow controller 500, 550, 600 (with adjustable valves 540) is connected to a foot support bladder 102, the flow regulator 120, valve 140, and/or fluid flow controller 500, 550, 600 (with adjustable valves 540) may be arranged so that impact force between a wearer's foot and the foot support bladder 102 will cause a pressure increase (or pressure impulse force or spike due to the ground contact) that helps more forcefully seat the movable valve part (e.g., 148, 580) in the valve seating area 144, 560S. This may occur, for example, if the force 196 shown in FIGS. 5A to 6 is pressure from the foot support fluid-filled bladder 102. Similar features are described above in conjunction with FIGS. 3D and 4D, and the same or similar features and/or advantages can be realized in the examples of FIGS. 5A-6.

The discussion of FIGS. 5A-6 above generally describe manners in which the crack pressure of an adjustable valve 540 can be varied and controlled. Such features may be useful to end users of articles of footwear, e.g., to vary or control the pressure in foot support bladders, to prevent excess build-up of pressure in a fluid-filled bladder, and/or to provide a combined pressure equalizer and check valve assembly, all of which are described above. The ability to vary and control the crack pressure of a valve 540 may have other uses as well. For example, aspects of the fluid flow control systems 500, 550, 600 and/or the adjustable and/or variable crack pressure of valve 540 may be applied to technology other than footwear (e.g., in any desired fluid flow environment, such as environments that utilize check valves). As other examples, aspects of the invention described above in conjunction with FIGS. 5A to 6 may be used during manufacture of footwear and/or footwear sole structures, e.g., to match one or more foot support pressure setting levels in one shoe with one or more foot support pressure setting levels in another shoe (e.g., the opposite shoe of a pair, a later manufactured second pair of shoes for the same user, etc.).

Such systems and methods for setting foot support pressure for a shoe sole (e.g., to match that shoe sole's pressure setting(s) and/or crack pressure of a check valve with the shoe sole pressure setting(s) and/or crack pressure of a check valve of another shoe) may include: (a) measuring a first pressure of a first foot support fluid-filled bladder 102 of a first sole 1004 of a pair of shoe soles; (b) measuring a pressure of a second foot support fluid-filled bladder 102 of a second sole 1004 of the pair of shoe soles, wherein the second foot support fluid-filled bladder 102 is connected to a fluid source 104 via an adjustable valve 540 having: (i) a fixed valve part 560 including a valve component seating area 560S, and (ii) a movable valve part 580 including a portion movable into and out of contact with the valve component seating area 560S, wherein the movable valve part 580 includes at least a portion made from a magnetic attractable material; and (c) determining at least one of a magnetic field strength, a magnet 562 physical location with respect to the movable valve part 580, or a current supplied to an electromagnet 552 necessary to set a crack pressure of the adjustable valve 540 at a value to maintain foot support pressure of the second foot support fluid-filled bladder 102 at a second pressure that is within a predetermined range from the first pressure (the second pressure for the second shoe sole 1004 may be exactly the same as the first pressure for the first shoe sole 1004). In this manner, the pressure settings and/or crack pressures for the two shoes of the pair can be matched up by the manufacturer in a relatively quick and easy manner (e.g., by changing the magnet 562 position and/or changing the electromagnet 552 current level settings).

When utilizing an electromagnet 552, the above systems and methods may further include providing input data to a controller 576 in electronic communication with the electromagnet 552 (which may be engaged with the second sole 1004 or with a component of a shoe 1000-5000 to which the second sole 1004 is engaged, such as an upper 1002). This input data may include electric current setting information that identifies the electric current to be supplied to the electromagnet 552 to set the crack pressure of the adjustable valve 540 at the value to maintain the second foot support fluid-filled bladder 102 at the second pressure.

For articles of footwear 1000 and/or sole structures 1004 capable of taking on multiple pressure settings, additional aspects of this invention may include: switching the second foot support fluid-filled bladder 102 from (a) a first pressure setting corresponding to a third pressure that is different from the second pressure to (b) a second pressure setting corresponding to the second pressure; and controlling current supplied to the electromagnet 552 to set the crack pressure of the adjustable valve 540 of the second sole 1004 at the value to maintain the second foot support fluid-filled bladder 102 at the second pressure.

If desired, an indicator may be provided on the second sole 1004 or on a component of a shoe (e.g., upper 1002) to which the second sole 1004 is engaged to mark the magnet 562 physical location with respect to the movable valve part 580 to set the crack pressure of the adjustable valve 540 at the value to maintain the second foot support fluid-filled bladder 102 at the second pressure. As one example, this may be accomplished in the systems of FIGS. 5A-5D by providing an indicator on the shoe sole 1004, upper 1002, or other footwear component 1010 at one or more of the track 574 stop locations 572A, 572B, and/or 572C that provide the different magnetic field strengths/magnetic forces on the movable valve part 580. This indicator may be a visual indicator or marking 610 or a designated stop location (such as a detent or other structure in the track 574) that stops the magnet 562 at the desired location(s) on the track 574. As another example, this indicator may be a visual indicator or marking 610 or a designated stop location (such as a detent or other structure) that stops the rotary dial 168 at the desired rotary position(s), e.g., as shown in FIGS. 3A to 4D. The location for the indicator 610, once determined, can help one reliably and repeatably find the locations to achieve the desired crack pressure for the adjustable valve 540.

Setting the foot support pressure and/or crack pressure of an adjustable valve 540 may take place with both shoes 1000-5000 of a pair. Such systems and methods may include:

measuring a first pressure of a first foot support fluid-filled bladder 102 of a first sole 1004 of the pair of shoe soles 1004, wherein the first foot support fluid-filled bladder 102 is connected to a first fluid source 104 via a first adjustable valve 540 having: (a) a first fixed valve part 560 including a first valve component seating area 560S, and (b) a first movable valve part 580 including a first portion movable into and out of contact with the first valve component seating area 560S, wherein the first movable valve 580 part includes a first portion made from a magnetic attractable material;

measuring a second pressure of a second foot support fluid-filled bladder 102 of a second sole 1004 of the pair of shoe soles 1004, wherein the second foot support fluid-filled bladder 102 is connected to a second fluid source 104 via a second adjustable valve 540 having: (a) a second fixed valve part 560 including a second valve component seating area 560S, and (b) a second movable valve part 580 including a second portion movable into and out of contact with the second valve component seating area 560S, wherein the second movable valve part 580 includes a second portion made from a magnetic attractable material;

determining at least one of a first magnetic field strength, a first magnet 562 physical location with respect to the first movable valve part 580, or a first current supplied to a first electromagnet 552 necessary to set a first crack pressure of the first adjustable valve 540 at a value to maintain the first foot support fluid-filled bladder 102 within a first predetermined range (e.g., ±2 psi) of a first foot support pressure; and determining at least one of a second magnetic field strength, a second magnet 562 physical location with respect to the second movable valve part 580, or a second current supplied to a second electromagnet 552 necessary to set a second crack pressure of the second adjustable valve 580 at a value to maintain the second foot support fluid-filled bladder 102 within a second predetermined range (e.g., ±2 psi) of the first foot support pressure or another desired foot support pressure. The first predetermined range may be the same as the second predetermined range or these predetermined ranges may differ.

Optionally, if desired, one or more indicators 610 may be provided on the shoe sole 1004, upper 1002, or other footwear component 1010 to mark the location of the first magnet 562 to set the desired first crack pressure for the first sole structure 1004 and/or to mark the location of the second magnet 562 to set the desired second crack pressure for the second sole structure 1004.

When utilizing an electromagnet 552, the above systems and methods may further include providing first input data to a controller 576 in electronic communication with the first electromagnet 552 (which may be engaged with the first sole 1004 or with a component of the first shoe 1000-5000 to which the first sole 1004 is engaged). This first input data may include first current setting information that identifies the first electric current to be supplied to the first electromagnet 552 to set the first crack pressure of the first adjustable valve 540 at the value to maintain the first foot support fluid-filled bladder 102 within the first predetermined range. This system and method further may include providing second input data to the first controller 576 or a second controller 576 in electronic communication with the second electromagnet 552 (which may be engaged with the second sole 1004 or with a component of the second shoe 1000-5000 to which the second sole 1004 is engaged). This second input data may include second current setting information that identifies the second electric current to be supplied to the second electromagnet 552 to set the second crack pressure of the second adjustable valve 540 at the value to maintain the second foot support fluid-filled bladder 102 within the second predetermined range.

The added ability to control the crack pressure of valves 140, 540 in one or more shoes of a pair, e.g., as described above, allow a manufacturer to more easily match the pressure settings in the shoes of the pair (and thereby make any differences in the support pressures or pressure settings in the two shoes very small (e.g., less than ±2 psi in some examples, and less than ±1 psi or even less than ±0.5 psi or ±0.25 psi in some examples)). The ability to tune or adjust the crack pressures of valves 140, 540 after production of a shoe or sole using different magnets, magnetic field strengths, magnet positions, and/or currents to an electromagnet allows the shoe, sole, and/or fluid flow system to be manufactured under looser tolerances. The pressure settings on the two shoes of the pair may be tuned or adjusted during or after shoe/sole production by magnetic adjustments as described above.

Figure 7A:
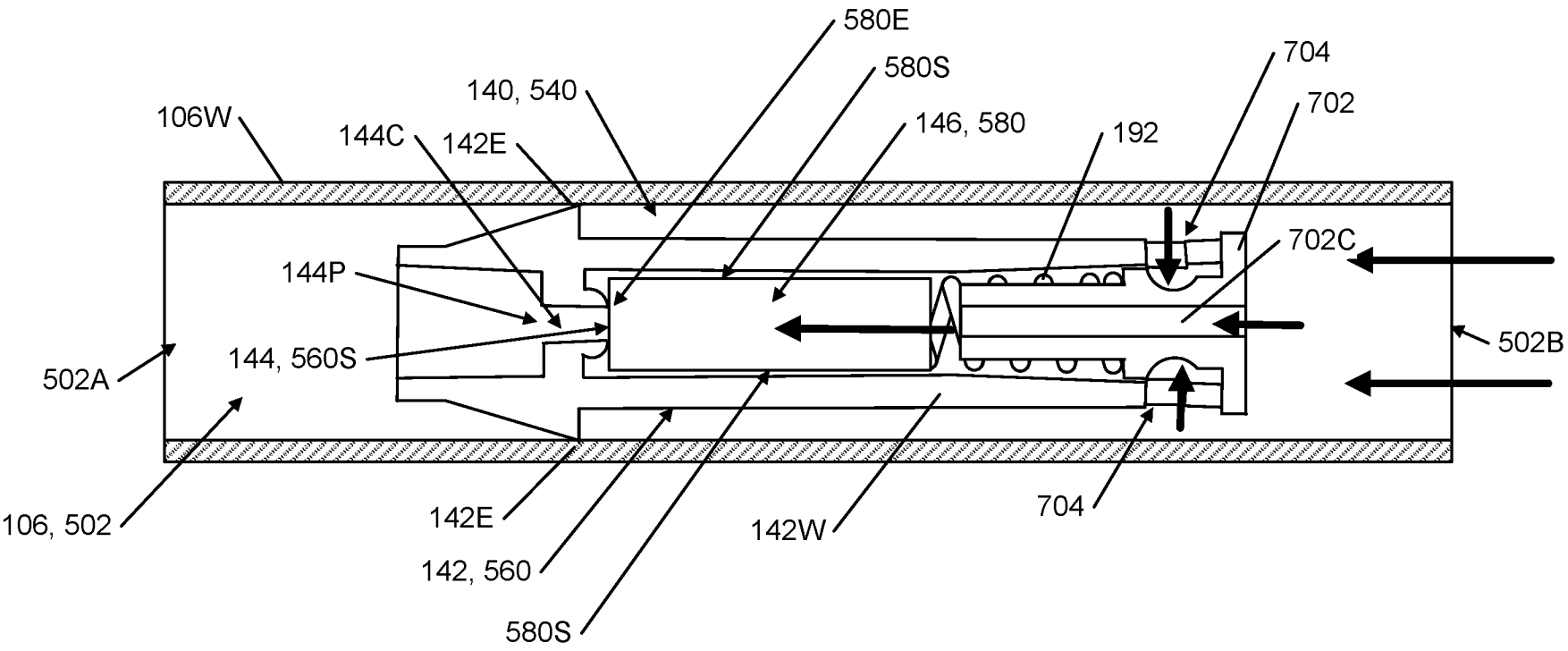
Figure 7B:
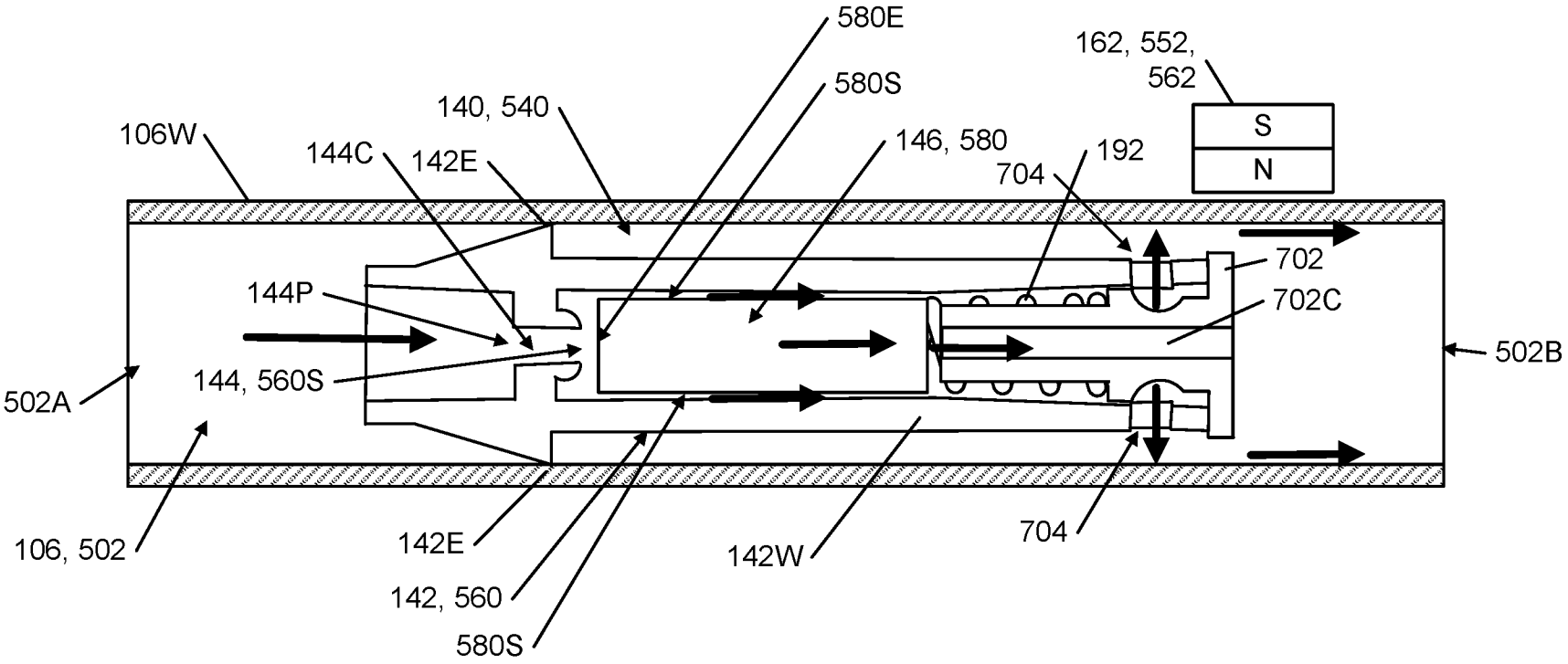

FIGS. 7A and 7B provide longitudinal cross sectional views of another example structure of a fluid flow control system and/or fluid line 106, 502 that includes a valve 140, 540 of the types described above (e.g., a combination equalizer and check valve, a valve having variable/adjustable crack pressure features, etc.). When the same reference number is used in FIGS. 7A and 7B as is used in FIGS. 1A-6, the same or similar parts are being referred to, and much of the repetitive description is omitted. The valve 140, 540 structure of FIGS. 7A and 7B may be used in any of the example arrangements, configurations, methods, articles of footwear, and/or sole structures described above in conjunction with FIGS. 1A-6.

In the structure shown in FIGS. 7A and 7B, the valve 140, 540 includes an outer housing that forms a fixed valve part 142, 560. The outer rim 142E of this fixed valve part 142, 540 engages interior wall(s) 106W of the fluid line 106, 502 to seal the fluid line 106, 502 for fluid flow. Thus, all fluid flow through this line 106, 502 must pass, in one direction or the other, through the valve 140, 540. The valve seating area 144, 560S of this example provides an inlet to channel 144C through the fixed valve part 142, 560. The housing/fixed valve part 142, 560 of this example may be made from a material that is not a magnetic attractable material (e.g., a plastic material). The movable valve part 146, 580 in this example, however, is made at least in part from a magnetic attractable material, e.g., of any of the types described above. The movable valve part 146, 580 may be slidingly mounted within the interior of the sidewall(s) 142W of the fixed valve part 142, 560, e.g., on one or more rails or other retaining devices so that fluid can flow around the exterior side(s) 580S of the movable valve part 146, 580. FIG. 7A shows the movable valve part 146, 580 in an arrangement that prevents fluid flow through the valve 140, 540 (e.g., a closed configuration), as the end 580E of the movable valve part 146, 580 seats and seals against the valve seating area 144, 560S under the force of biasing system spring 192 (and/or fluid pressure from the end 502B direction). Either or both of the valve seating area 144, 560S and/or the end 580E may be made from and/or include a material to enhance the sealing features (e.g., a rubberized material, a softer material, etc.). In this arrangement, fluid can flow from end 502B into the housing/fixed valve component 142, 560, but fluid flow around and/or through the valve 140, 540 is stopped by the sealed outer rim 142E and the seated movable valve component 146, 580 on the valve seating area 144, 560S.

This example valve 140, 540 further includes an end part 702 engaged with (e.g., friction fit, adhesively engaged, mechanically engaged, etc.) the opposite end of the fixed valve component 142, 560 from the valve seating area 144, 560S and/or channel 144C. This end part 702 may provide support/backstop for the biasing system (e.g., spring 192). The end part 702, while itself fixed in place with respect to the fixed valve part 142, 560, may be made from a magnetizable material, e.g., to enable it to transmit and/or convey magnetic force from a magnet 162, 552, 562 to the movable valve component 146, 580. A channel 702C allows fluid flow through the end part 702 and into the volume of the fixed valve part 142, 560 located within the sidewall(s) 142W of the housing/fixed valve part 142, 560 (i.e., into the fixed valve part's interior volume). Also, one or more ports 704 through the sidewall 142W of the housing/fixed valve part 142, 560 allow fluid flow into the housing/fixed valve part 142, 560 from locations within the fluid line 106, 502 outside the sidewall 142W.

FIG. 7B shows this example valve 140, 540 in an open configuration. In this configuration, additional fluid pressure from the first end 502A direction and/or additional force from a magnet 162, 562, 552 overcomes the combined force(s) of the biasing system (e.g., spring 192) and/or fluid pressure from the second end 502B direction to "crack" the valve 140, 540. This "cracking" unseats end 580E of the movable valve part 146, 580 from the valve seating area 144, 560S and opens channel 144C. Fluid can then flow through channel 144C from the end 502A direction, around the movable valve part 146, 580 (e.g., between the outer sidewall(s) 580S of the movable valve part 146, 580 and the interior sidewall(s) 142W of housing/fixed valve part 142, 560), into the channel 702C through the end part 702 and/or out of the housing/fixed valve part ports 704 toward (and optionally through) the end 502B of the fluid line 106, 502.

III. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A foot support system for an article of footwear, comprising:

a first footwear component;

a first fluid-filled container or bladder support engaged with the first footwear component, wherein the first fluid-filled container or bladder support includes a gas at a first pressure;

a second fluid-filled container or bladder support engaged with the first footwear component or a second footwear component, wherein the second fluid-filled container or bladder support includes a gas at a second pressure;

a first fluid transfer line placing the first fluid-filled container or bladder support in fluid-communication with the second fluid-filled container or bladder support;

a valve located in or connected to the first fluid transfer line, wherein the valve is switchable between an open condition and a closed condition and includes: (a) a fixed valve part including a valve component seating area, (b) a movable valve part including a ball movable into and out of contact with the valve component seating area, and (c) a biasing component configured to apply a biasing force to the ball in a direction toward the closed condition, wherein the biasing component includes a spring applying the biasing force to the ball; and a control system configured to change the valve between the open condition and the closed condition, wherein when the second pressure is greater than the first pressure, the control system: (a) holds the valve in the closed condition and inhibits gas from moving from the second fluid-filled container or bladder support, through the first fluid transfer line and valve, and into the first fluid-filled container or bladder support or (b) is selectively controllable to move the valve to the open condition and allow fluid to move from the second fluid-filled container or bladder support, through the first fluid transfer line and valve, and into the first fluid-filled container or bladder support, and wherein when the first pressure is greater than the second pressure by at least a first predetermined amount, gas from the first fluid-filled container or bladder support: (a) causes the movable valve part to move out of contact with the valve component seating area and (b) moves from the first fluid-filled container or bladder support, through the valve and first fluid transfer line, and into the second fluid-filled container or bladder support.

2. The foot support system according to claim 1, wherein the first fluid transfer line includes a flexible plastic tube having an interior channel, and wherein the valve is located within the interior channel of the flexible plastic tube.

3. The foot support system according to claim 1, wherein the fixed valve part includes: (i) a first end forming a stop surface as at least a portion of the valve component seating area and a first fluid port, (ii) a second end having a second fluid port, and (iii) a fluid channel extending through the fixed valve part from the first fluid port to the second fluid port; and wherein the biasing component applies the biasing force to the ball in a direction toward the stop surface.

4. The foot support system according to claim 3, wherein in the open condition, the control system applies a force to the ball sufficient to overcome the biasing force of the biasing component and sufficient to hold the ball at a location spaced from the stop surface of the fixed valve part, and wherein in the closed condition, the biasing force applied by the biasing component to the ball places the ball against the stop surface of the fixed valve part.

5. The foot support system according to claim 1, wherein the spring is located at least partially within an interior chamber defined between a first end and a second end of the fixed valve part.

6. The foot support system according to claim 1, wherein the fixed valve part includes: (i) a first end forming a stop surface as at least a portion of the valve component seating area and a first fluid port, (ii) a second end having a second fluid port, and (iii) a fluid channel extending through the fixed valve part from the first fluid port to the second fluid port;

wherein in the open condition, the control system applies a force to the ball sufficient to hold the ball at a location spaced from the stop surface of the fixed valve part; and wherein in the closed condition, the ball is held against the stop surface of the fixed valve part.

7. The foot support system according to claim 1, wherein the ball includes a magnet and/or at least a portion made from a material attracted to a magnet, and wherein the control system includes one of: (a) a permanent magnet that is movable between a first position and a second position to change the valve between the open condition and the closed condition, or (b) an electromagnet that is switchable between a powered condition and an unpowered condition or a reduced power condition to change the valve between the open condition and the closed condition.

8. The foot support system according to claim 1, further comprising:

a pump to move fluid from the first fluid-filled container or bladder support to the second fluid-filled container or bladder support;

a second fluid transfer line connecting the first fluid-filled container or bladder support to the pump;

a first one-way valve in the second fluid transfer line that allows fluid flow from the first fluid-filled container or bladder support to the pump but inhibits fluid flow from the pump to the first fluid-filled container or bladder support via the second fluid transfer line;

a third fluid transfer line connecting the pump to the second fluid-filled container or bladder support; and a second one-way valve in the third fluid transfer line that allows fluid flow from the pump to the second fluid-filled container or bladder support but inhibits fluid flow from the second fluid-filled container or bladder support to the pump via the third fluid transfer line.

9. The foot support system according to claim 1, wherein the first footwear component is a sole structure, and wherein the first fluid-filled container or bladder support includes a surface oriented in the article of footwear to support at least a portion of a plantar surface of a wearer's foot.

10. A foot support system for an article of footwear, comprising:

a first footwear component;

a first fluid-filled container or bladder support engaged with the first footwear component;

a second fluid-filled container or bladder support engaged with the first footwear component or a second footwear component;

a first fluid transfer line placing the first fluid-filled container or bladder support in fluid-communication with the second fluid-filled container or bladder support;

a valve located in or connected to the first fluid transfer line, wherein the valve is switchable between: (a) an open condition in which fluid flows through the valve and through the first fluid transfer line and (b) a closed condition in which fluid flow through the first fluid transfer line is stopped by the valve, wherein the valve includes: (i) a fixed valve part including a valve component seating area, (ii) a movable valve part including a ball movable into and out of contact with the valve component seating area, and (iii) a biasing component configured to apply a biasing force to the ball in a direction toward the closed condition, wherein the biasing component includes a spring applying the biasing force to the ball; and a control system that changes the valve between the open condition and the closed condition.

11. The foot support system according to claim 10, wherein the first fluid transfer line includes a flexible plastic tube having an interior channel, and wherein the valve is located within the interior channel of the flexible plastic tube.

12. The foot support system according to claim 10, wherein the fixed valve part includes: (i) a first end forming a stop surface as at least a portion of the valve component seating area and a first fluid port, (ii) a second end having a second fluid port, and (iii) a fluid channel extending through the fixed valve part from the first fluid port to the second fluid port; and wherein the biasing component applies the biasing force to the ball in a direction toward the stop surface.

13. The foot support system according to claim 12, wherein in the open condition, the control system applies a force to the ball sufficient to overcome the biasing force of the biasing component and sufficient to hold the ball at a location spaced from the stop surface of the fixed valve part, and wherein in the closed condition, the biasing force applied by the biasing component to the ball places the ball against the stop surface of the fixed valve part.

14. The foot support system according to claim 10, wherein the spring is located at least partially within an interior chamber defined between a first end and a second end of the fixed valve part.

15. The foot support system according to claim 10, wherein the fixed valve part includes: (i) a first end forming a stop surface as at least a portion of the valve component seating area and a first fluid port, (ii) a second end having a second fluid port, and (iii) a fluid channel extending through the fixed valve part from the first fluid port to the second fluid port;

wherein in the open condition, the control system applies a force to the ball sufficient to hold the ball at a location spaced from the stop surface of the fixed valve part; and wherein in the closed condition, the ball is held against the stop surface of the fixed valve part.

16. The foot support system according to claim 10, wherein the ball includes a magnet and/or at least a portion made from a material attracted to a magnet, and wherein the control system includes one of: (a) a permanent magnet that is movable between a first position and a second position to change the valve between the open condition and the closed condition, or (b) an electromagnet that is switchable between a powered condition and an unpowered condition or a reduced power condition to change the valve between the open condition and the closed condition.

17. The foot support system according to claim 10, further comprising:

a pump to move fluid from the first fluid-filled container or bladder support to the second fluid-filled container or bladder support;

a second fluid transfer line connecting the first fluid-filled container or bladder support to the pump;

a first one-way valve in the second fluid transfer line that allows fluid flow from the first fluid-filled container or bladder support to the pump but inhibits fluid flow from the pump to the first fluid-filled container or bladder support via the second fluid transfer line;

a third fluid transfer line connecting the pump to the second fluid-filled container or bladder support; and a second one-way valve in the third fluid transfer line that allows fluid flow from the pump to the second fluid-filled container or bladder support but inhibits fluid flow from the second fluid-filled container or bladder support to the pump via the third fluid transfer line.

18. The foot support system according to claim 10, wherein the first footwear component is a sole structure, and wherein the first fluid-filled container or bladder support includes a surface oriented in the article of footwear to support at least a portion of a plantar surface of a wearer's foot.

* * * * *